US008009007B2

(12) United States Patent
Utsuno et al.

(10) Patent No.: US 8,009,007 B2
(45) Date of Patent: Aug. 30, 2011

(54) INDUCTANCE PART

(75) Inventors: Mizuki Utsuno, Niiza (JP); Tomohiro Miyata, Niiza (JP); Sadahiro Yamazaki, Niiza (JP); Shigenori Ishii, Niiza (JP)

(73) Assignee: Sanken Electric Co., Ltd., Saitama (JP)

( * ) Notice: Subject to any disclaimer, the term of this patent is extended or adjusted under 35 U.S.C. 154(b) by 104 days.

(21) Appl. No.: 12/618,475

(22) Filed: Nov. 13, 2009

(65) Prior Publication Data

US 2010/0127813 A1 May 27, 2010

(30) Foreign Application Priority Data

Nov. 26, 2008 (JP) ..... 2008-301366

(51) Int. Cl.
*H01F 5/00* (2006.01)

(52) U.S. Cl. ..... 336/200

(58) Field of Classification Search ..... 336/65, 336/83, 198, 200, 232
See application file for complete search history.

(56) References Cited

U.S. PATENT DOCUMENTS 5,684,445 A * 11/1997 Kobayashi et al. ..... 336/83
5,748,064 A * 5/1998 Smeenge et al. ..... 336/83
6,046,662 A * 4/2000 Schroter et al. ..... 336/83

FOREIGN PATENT DOCUMENTS

JP 62-76509 A 4/1987
JP 8-316040 A 11/1996
JP 2003-142323 A 5/2003

* cited by examiner

*Primary Examiner* — Tuyen Nguyen
(74) *Attorney, Agent, or Firm* — Birch, Stewart, Kolasch & Birch, LLP

(57) ABSTRACT

Since there exists a draw-out portion of a triple insulated wire in a winding structure of a transformer in which the triple insulated wire is used as a secondary winding, the thickness of the transformer is increased by an amount corresponding to the wire diameter of the draw-out portion. Further, when reduction of the thickness of the transformer is prioritized, the secondary winding can be provided only on one side, making it impossible to achieve the sandwich structure. Thus, the coupling between the primary and secondary windings has been sacrificed. An inductance part provided with a magnetic core, two or more sheet coils, and a winding includes: a bobbin constituted by at least two or more sheet coils; and a winding formed by winding a triple insulated wire between the two or more sheet coils constituting the bobbin. A triple insulated wire draw-out portion on the center side of the winding is drawn out to one outer surface side of the bobbin.

11 Claims, 23 Drawing Sheets

36
25
4
5
34
37
26
4
35
5
41 (4)
11
12
37
25
36
40
42 (4)

Plan view

Fig.11B Side view
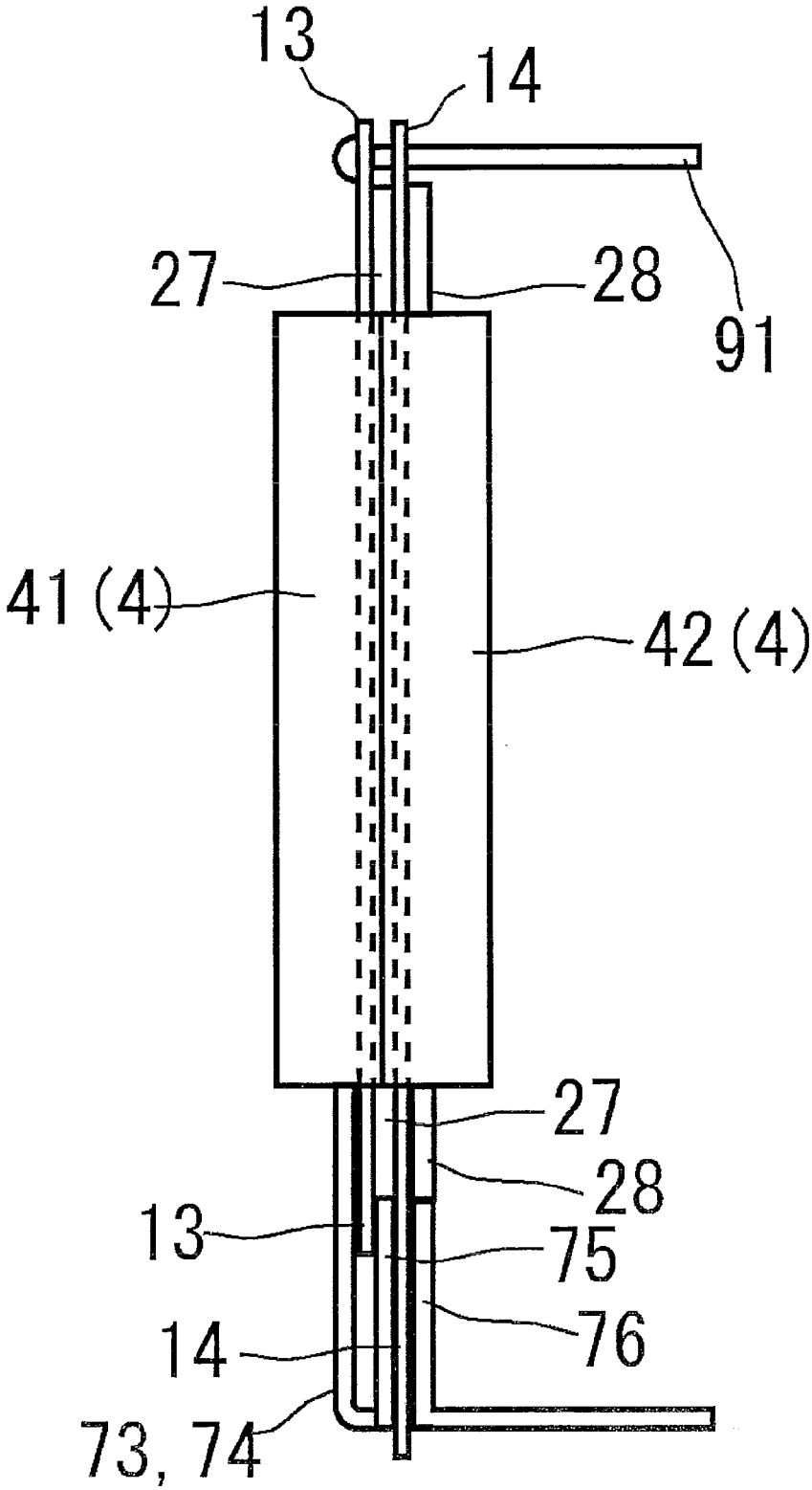

A-A cross-sectional view

INDUCTANCE PART

BACKGROUND OF THE INVENTION

1. Field of the Invention

The present invention relates to an inductance part such as a transformer, a choke coil, and the like used for a power supply unit and, more particularly, to an inductance part provided with a plurality of windings and a magnetic core inserted through the windings.

2. Description of the Related Art

With a reduction in the weight, thickness, length and size of an electronic part, a switching power supply unit undergoes miniaturization and, accordingly, an inductance part which is a component used in the switching power unit is also required to be reduced in the thickness. Conventionally, as a transformer which is an inductance part, a sheet transformer as disclosed in Japanese Patent Application No. JP-A-62-76509 (refer to Patent Document 1) has been proposed. In general, a primary winding of a transformer used in a switching power supply has a large number of turns and draws less current, so that it is suitably used as a sheet coil. As an example of a sheet coil that has conventionally been used, there is known one disclosed in Japanese Patent Application No. JP-A-2003-142323 (refer to Patent Document 2: paragraphs [0004] to [0006]). As described in this document, in order to increase the number of turns, a multilayer structure is adopted and windings formed in a plurality of layers are connected in series.

However, a secondary winding has a low voltage and smaller number of turns but draws comparatively a larger current, so that there may occur a case where a use of only the sheet coil is not sufficient due to the limitation of output current rating. Therefore, it is often a case where a triple insulated wire having the wire surface onto which triple insulation coating has been applied is used to constitute the sheet transformer. An example of this technique is disclosed, as an improvement for the sheet transformer, in Japanese Patent Application No. JP-A-08-316040 (refer to Patent Document 3). In Patent Document 3, a tape is stuck on a secondary winding (triple insulation wire, etc.) that has been subjected to at least a single insulation coating for simultaneously achieving both fixing of the secondary winding and insulation between the secondary winding and a magnetic core.

According to a winding structure of Patent Document 3, the secondary winding contacts a sheet coil as the primary winding only at one surface, preventing the second winding and sheet coil from being tightly-coupled. In order to achieve the tight coupling between the second winding and sheet coil, there can be considered a structure in which sheet coils 1011 and 1012 which are obtained by dividing one sheet coil into two are disposed both above and below a secondary winding 102 as illustrated in a cross-sectional view of FIG. 12 partly illustrating a winding structure, or secondary windings 1021 and 1022 which are obtained by dividing one secondary winding into two are disposed both above and below a sheet coil 101 as illustrated in a cross-sectional view of FIG. 13 partly illustrating a winding structure. However, since there exists a secondary winding draw-out portion (triple insulated wire draw-out portion) 1031 in FIG. 12, secondary winding draw-out portions (triple insulated wire draw-out portions) 1033 and 1034 in FIG. 13, the thickness of a transformer is increased by an amount corresponding to the wire diameter of the draw-out portion. When reduction of the thickness of the transformer is prioritized, the secondary winding can be provided only on one side, making it impossible to achieve the sandwich structure. Thus, the coupling between the primary and secondary windings has been sacrificed.

Reference numerals 105, 1051, and 1052 in FIG. 12 and FIG. 13 each denote a spacer serving as member for achieving insulation between the secondary winding and magnetic core 104 and as a bobbin core for winding the secondary winding therearound. FIG. 12 and FIG. 13 each illustrate only one side (left side) of the cross-section of structures of the primary and secondary windings wound around the magnetic core 104. Further, in FIG. 12, a reference numeral 1031 denotes a secondary winding draw-out portion (triple insulated wire draw-out portion) at which the secondary winding 102 is drawn out with the winding start portion thereof in the lead, and reference numeral 1032 denotes a secondary winding draw-out portion (triple insulated wire draw-out portion) at which the secondary winding 102 is drawn out with the winding end portion thereof in the lead. Further, in FIG. 13, a reference numeral 1033 denotes a secondary winding draw-out portion (triple insulated wire draw-out portion) at which the secondary winding 1021 is drawn out with the winding start portion thereof in the lead, and reference numeral 1035 denotes a secondary winding draw-out portion (triple insulated wire draw-out portion) at which the secondary winding 1021 is drawn out with the winding end portion thereof in the lead. Further, in FIG. 13, a reference numeral 1034 denotes a secondary winding draw-out portion (triple insulated wire draw-out portion) at which the secondary winding 1022 is drawn out with the winding start portion thereof in the lead, and reference numeral 1036 denotes a secondary winding draw-out portion (triple insulated wire draw-out portion) at which the secondary winding 1022 is drawn out with the winding end portion thereof in the lead.

SUMMARY OF THE INVENTION

In view of the above problem, an object of the present invention is to provide a structure capable of reducing leakage inductance by tightly coupling the sheet coil and a winding wire and capable of further reducing the thickness of the transformer.

According to an aspect of the present invention, there is provided an inductance part provided with a magnetic core, a sheet coil, and an insulated wire, including: a bobbin constituted by two or more sheet coils; and a winding formed by winding the insulated wire between the two or more sheet coils constituting the bobbin, wherein a draw-out wire on the center side of the winding passes through the center portion of the bobbin to be drawn out to one outer surface side of the bobbin.

In the present invention, there is an inductance part, wherein a hole through which the magnetic core is inserted is formed in the center portion of the sheet coil, and a cut portion through which the draw-out wire of the winding passes is formed in the outer peripheral portion of the hole.

In the present invention, there is an inductance part, wherein the draw-out wire on the center side of the winding that has been drawn out from the center portion of the bobbin is wound in the opposite direction to the winding on the one outer surface of the bobbin to form a winding.

In the present invention, there is an inductance part, wherein the bobbin includes, between the two or more sheet coils, a spacer for forming a space within which the winding is accommodated.

In the present invention, there is an inductance part, wherein the spacer is disposed between the winding and magnetic core.

In the present invention, there is an inductance part, wherein a cut portion through which the draw-out wire of the winding passes is formed in the spacer.

In the present invention, there is an inductance part, wherein the spacer is disposed so as to be brought into contact with the outer periphery of the winding.

In the present invention, there is an inductance part, wherein another winding is disposed on another outer surface side opposite to the one outer surface side of the bobbin to which the draw-out wire is drawn out, and a draw-out wire of the another winding on the center side thereof is drawn out, through the two or more sheet coils, to the one outer surface side of the bobbin to which the draw-out wire of the winding has been drawn out.

Further, the inductance part according to the present invention includes: three or more sheet coils; and two or more windings sandwiched between the three or more sheet coils, wherein draw-out wires of the two or more windings interposed between the three or more sheet coils are drawn out, through the three or more sheet coils sandwiching the two or more windings, to the one outer surface side of the bobbin.

According to the present invention, the draw-out portion of the insulated wire does not interfere with close attachment between the sheet coil and winding wire, so that a satisfactory coupling between the sheet coil and winding can be achieved to thereby reduce leakage inductance and reduce the thickness of a transformer.

BRIEF DESCRIPTION OF THE DRAWINGS

FIG. 11A to FIG. 11C are views illustrating the structure of the transformer according to the third embodiment of the present invention;

DESCRIPTION OF THE PREFERRED EMBODIMENTS

Preferred embodiments for practicing the present invention will be described concretely with reference to the accompanying drawings. In the following description, it is assumed that sheet coil 11 is an upper side coil and sheet coil 12 is a lower side coil for convenience of the explanation. However, it goes without saying that upper side and lower side may be reversed in a practical configuration. The same can be said for the positional relationship between sheet coils 13 and 14.

First Embodiment

Figure 1:
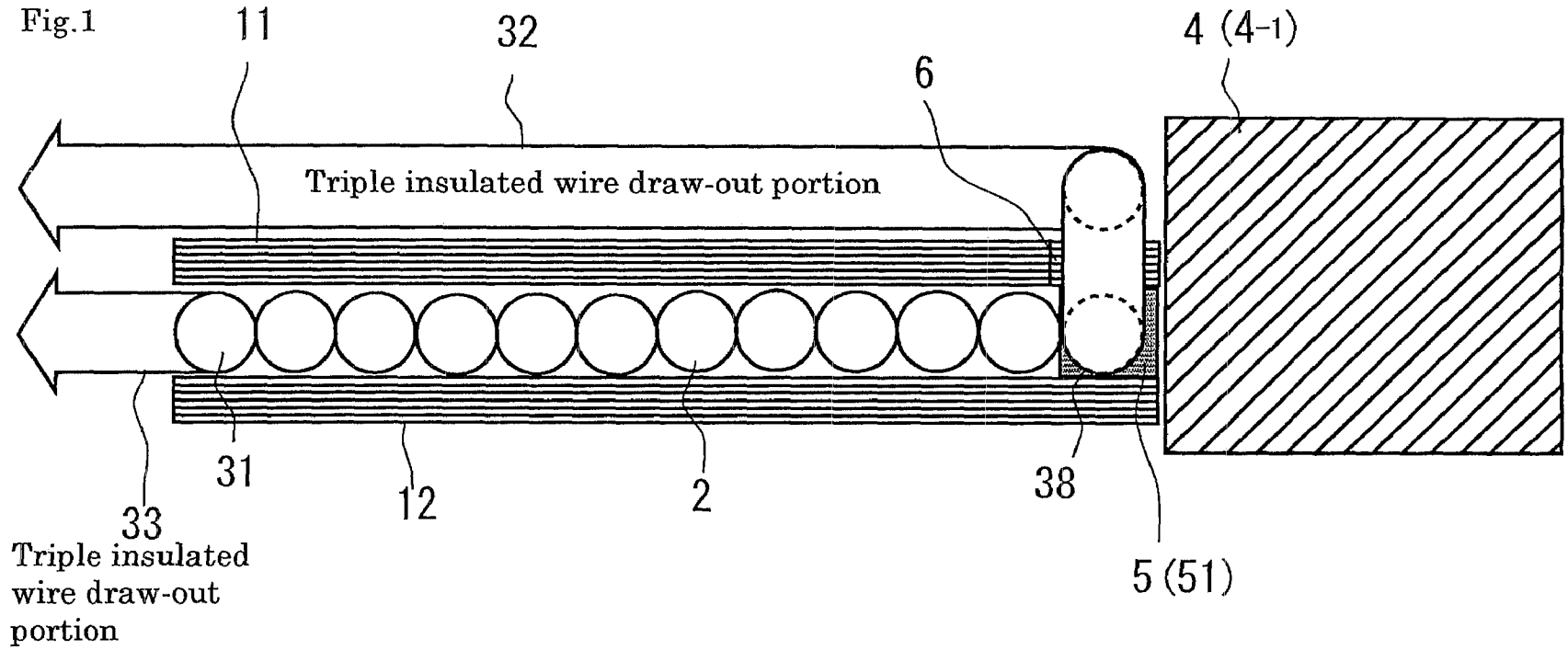
FIG. 1 is a cross-sectional view partly illustrating a transformer winding structure according to a first embodiment of the present invention.

FIG. 1 is a cross-sectional view partly illustrating a winding structure of a transformer 30 according to the first embodiment of the present invention. Primary and secondary windings are constituted by the sheet coils 11 and 12 and a winding 2 obtained by winding a triple insulated wire around a magnetic core 4 (magnetic core portion 4-1 positioned inside the winding) through a spacer 5. These primary and secondary windings are magnetically linked to each other so as to generate a flux in the magnetic core 4 in common. Whether which one of the sheet coil (sheet coils 11 and 12) and winding 2 serves as the primary winding (or secondary winding) is determined depending on the use state. Thus, in the following description, it is assumed that a coil formed on a printed board is "sheet coil" and a coil formed by winding a triple insulated wire is "winding", without making a distinction between the primary and secondary windings.

As illustrated in FIG. 1, the winding structure of the present embodiment has a sandwich structure, that is, the winding 2 is sandwiched between the sheet coils 11 and 12. A winding start portion 38 at on end portion of the winding 2 is drawn out to the upper surface of the sheet coil 11 through a cut portion 51 (refer to FIG. 2C) of the spacer 5 and a cut portion 6 (refer to FIG. 2B) of the sheet coil 11. On the other hand, a winding end portion 31 at the other end of the winding 2 is drawn outside from the outer peripheral portion of the winding 2. The wire that has been drawn out, with the winding start portion 38 in the lead, to the upper surface of the sheet coil 11 is drawn out as one triple insulated wire draw-out portion 32, and wire that has been drawn outside, with the winding end portion 31 in the lead, is drawn out as the other one triple insulated wire draw-out portion 33.

With the above configuration, the sheet coils 11 and 12 are closely attached to both the upper and lower surfaces of the winding 2 to achieve a satisfactory coupling between the sheet coils 11 and 12 and winding 2, thereby reducing leakage inductance and thickness of the transformer.

With reference to FIG. 2A to FIG. 2H, the configuration of the transformer 30 will be described in more detail.

Figure 2A:
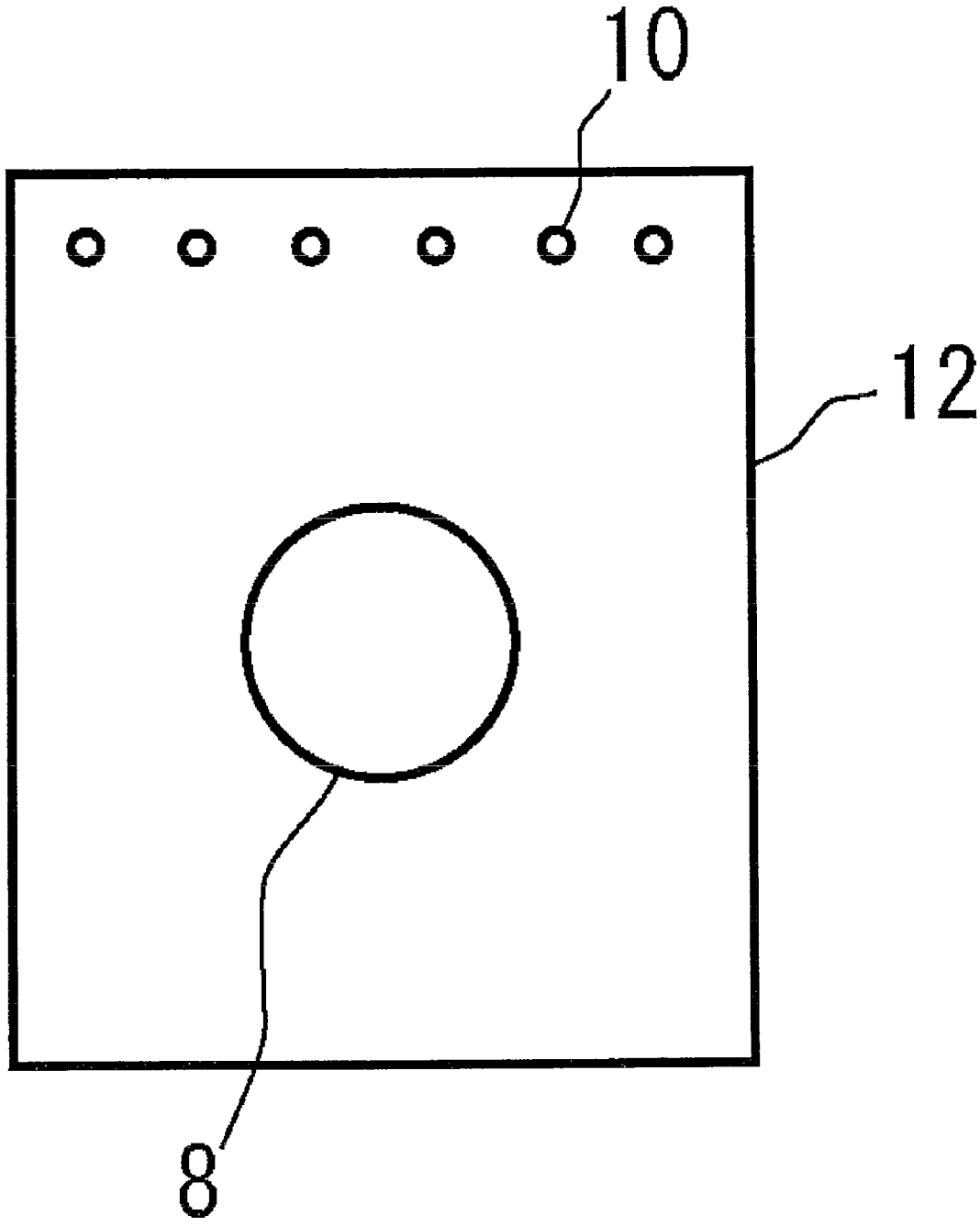
FIG. 2A to FIG. 2H are views for explaining an assembly process of the transformer according to the first embodiment of the present invention.

FIG. 2A illustrates the sheet coil 12 which is formed on a printed board made of a material such as epoxy resin. The sheet coil 12 is made multilayered as needed, e.g., when the number of tunes is required to be increased. As a concrete example of the sheet coil, one disclosed in the Japanese Patent Application No. JP-A-2003-142323 can be taken. Although the sheet coil 12 has substantially a rectangular outer shape in the present embodiment, the outer shape of the sheet coil 12 is not limited to this. For example, the sheet coil 12 may be formed in a circular outer shape in accordance with the outer shape of the winding. A circular hole 8 is formed in substantially the center of the sheet coil 12 so as to allow the magnetic core 4 to be inserted therethrough. The inner shape of the hole 8 is formed in accordance with the shape of the magnetic core 4, and the diameter thereof is slightly larger than the outer diameter of the magnetic core 4 so as to allow the magnetic core 4 to easily be inserted through the hole 8 at assembly time. The shape of the inner diameter of the hole 8 is not limited to a circle. For example, when the magnetic core 4 has a rectangular cross-sectional shape, the hole 8 is formed in a rectangular inner diameter shape. Further, a plurality of through holes 10 are formed in the sheet coil 12 for receiving fixing pins 91 used when the transformer is mounted on a not-illustrated circuit board.

Figure 2B:
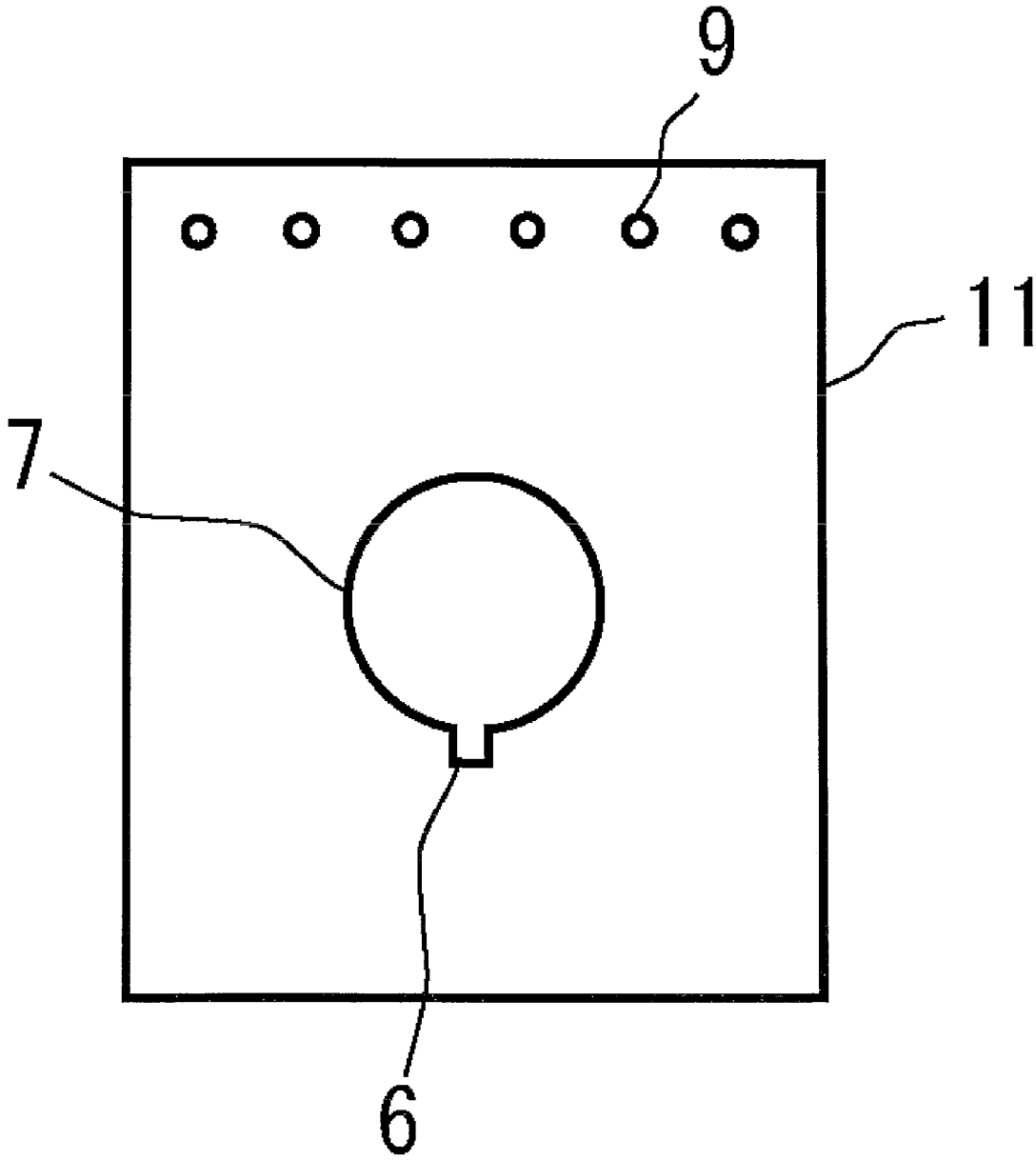

FIG. 2B illustrates a sheet coil 11 which is formed on a printed board made of a material such as epoxy resin, like the sheet coil 12. Further, like the sheet coil 12, the sheet coil 11 is made multilayered as needed, e.g., when the number of tunes is required to be increased. A circular hole 7 is formed in substantially the center of the sheet coil 11 so as to allow the magnetic core 4 to be inserted therethrough. The inner diameter of the hole 7 is set equal to the outer diameter of hole 8 of the sheet coil 12 so as to allow the magnetic core 4 to easily be inserted through the hole 8 at assembly time. The shape of the inner diameter of the hole 7 is not limited to a circle, like the hole 8. A plurality of through holes 9 are formed also in the sheet coil 11 for receiving fixing pins 91 as in the case of the though holes 10. The through holes 9 and 10 are formed so as to be positioned at the same locations when the sheet coils 11 and 12 are fitted to each other at assembly time. Thus, each fixing pin 91 can be inserted through the through holes 9 and 10 simultaneously. A cut portion 6 is formed in the sheet coil 11 so as to extend outside from the outer peripheral portion of the hole 7. The cut portion 6 is a portion through which the triple insulated wire draw-out portion 32 at which the winding 2 is drawn out to the upper surface of the sheet coil 11 with the second winding start portion 38 in the lead passes and is formed to have a width large enough to allow the triple insulated wire draw-out portion 32 to pass therethrough.

Figure 2C:
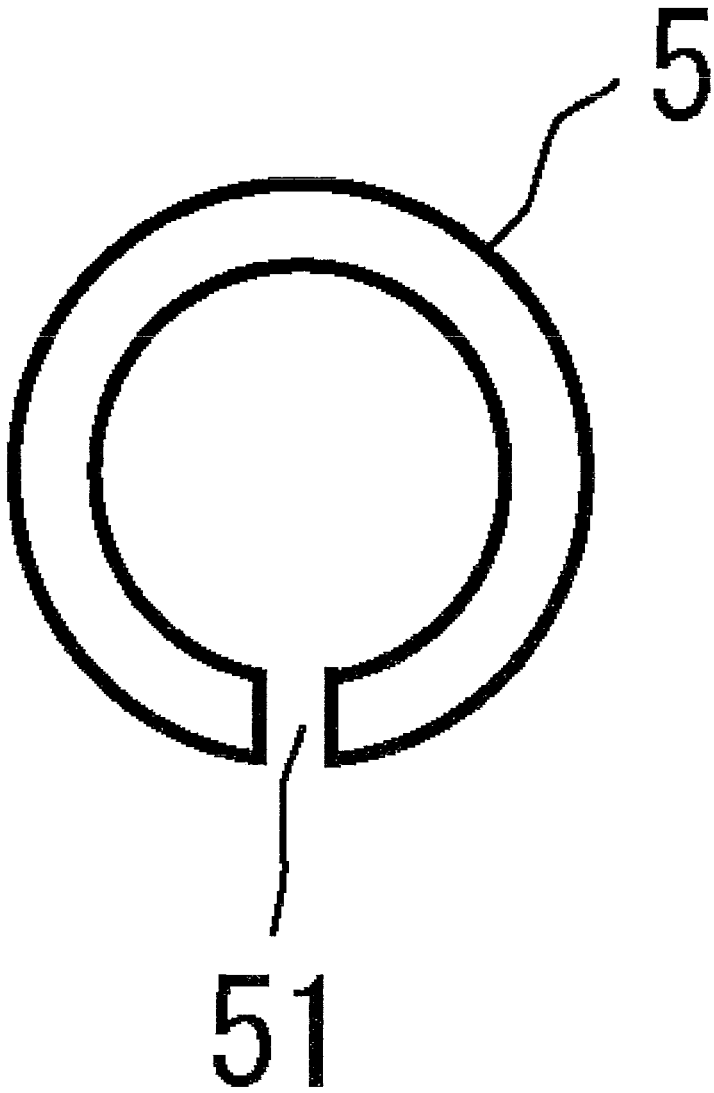

FIG. 2C illustrates the spacer 5 made of the same material as that of the printed board for the sheet coil. The spacer 5 has a cut portion 51 formed in a part of the donut (ring-donut) shape thereof. The spacer 5 functions not only as a spacer for achieving electrical insulation between the magnetic core 4 (magnetic core portion 4-1 positioned inside the winding) and for ensuring a space for forming the winding 2 constituted by a triple insulated wire between the sheet coils 11 and 12, but also as a spacer for drawing out the triple insulated wire from the lower surface side of the sheet coil 11 to the upper surface side thereof through the cut portion 51. Further, the spacer 5 constitutes a bobbin of the winding 2 together with the sheet coils 11 and 12 to thereby serve as a core around which the winding 2 is wound. The material of the spacer 5 need not be the same as that of the printed board for the sheet coil.

Figure 2D:
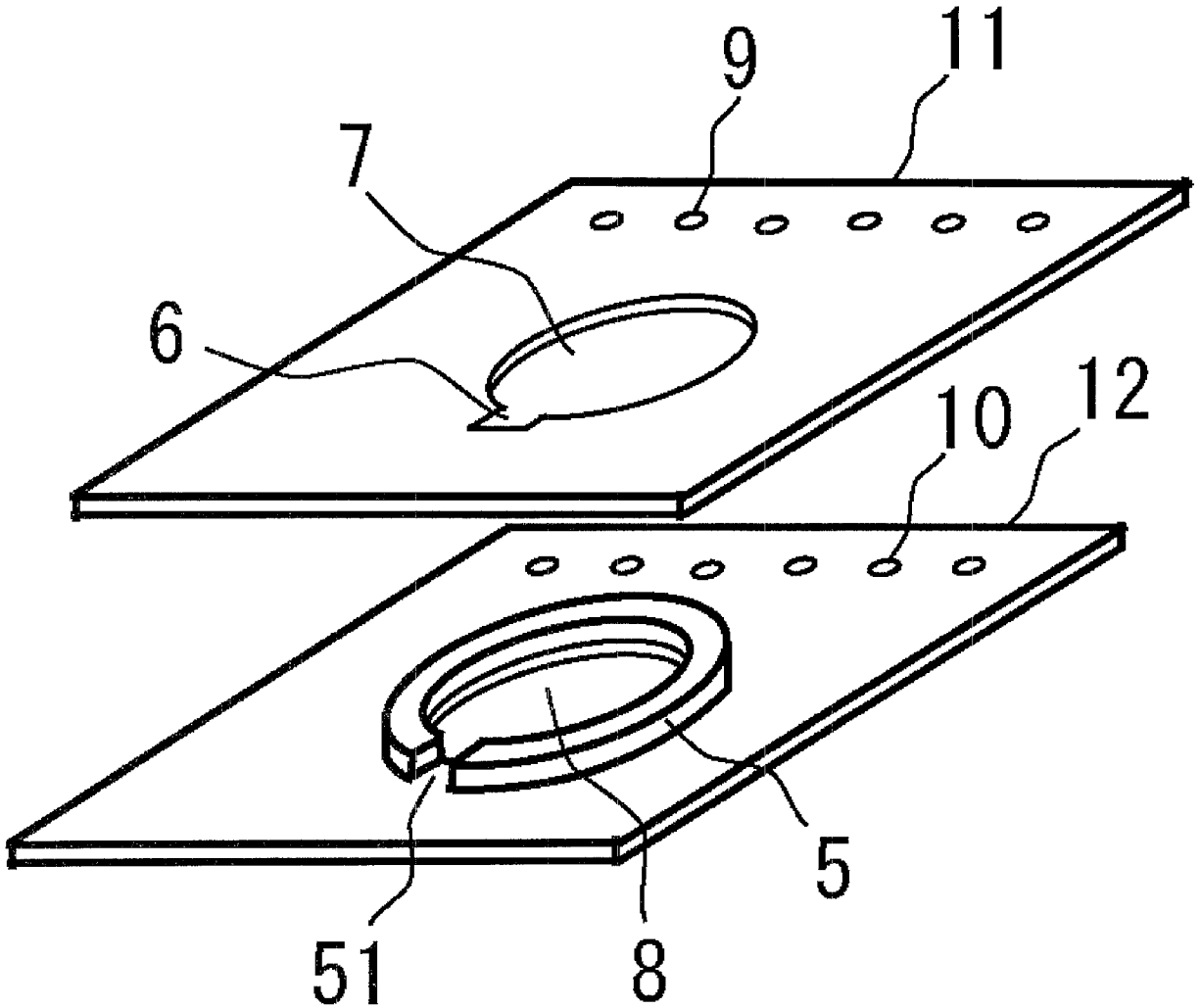

By bonding and fixing the sheet coils 11 and 12 and spacer 5 illustrated in FIG. 2A to FIG. 2C in a state where the spacer 5 is interposed between the sheet coils 11 and 12 as illustrated in FIG. 2D, a structure combining sheet coil and bobbin is obtained. Since the cut portion 6 is formed corresponding to the cut portion 51 of the spacer 5, the cut portion 51 and cut portion 6 are positioned so as to correspond to each other at the bonding time. Thus, when the triple insulated wire is wound around the sheet coil-bobbin structure to constitute the winding 2, it is possible to easily guide the triple insulated wire draw-out portion 32 which is a draw-out wire of the winding 2 to the upper surface side of the sheet coil 11.

Figure 2E:
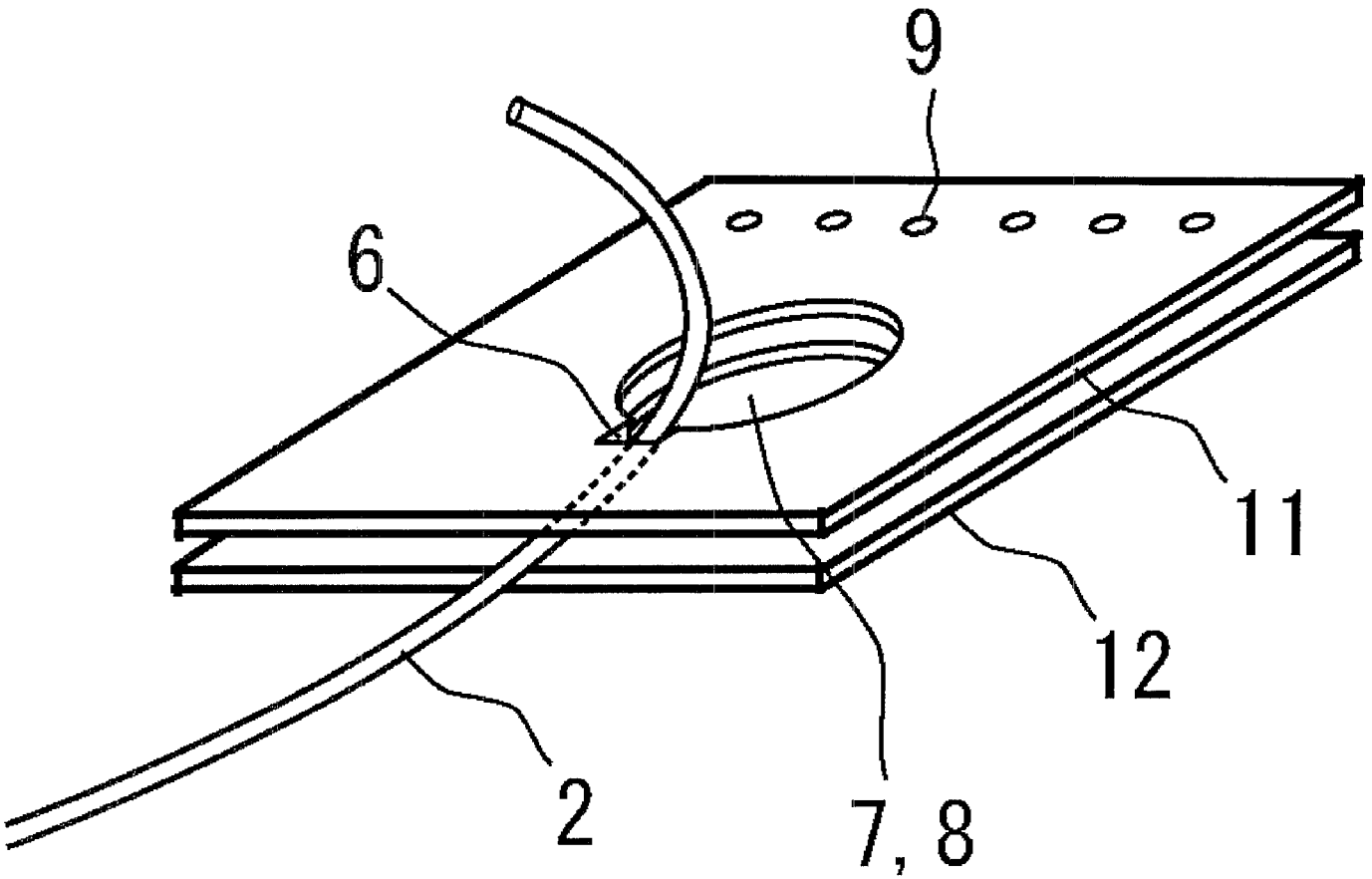

Then, as illustrated in FIG. 2E, the triple insulated wire is inserted between the sheet coils 11 and 12 from outside toward the holes 7 and 8, and the leading end of the triple insulated wire is inserted through the cut portion 51 of the spacer 5. Then, the leading end of the triple insulated wire that has reached near the center of the holes 7 and 8 is picked upward so as to be bent at the cut portion 6. As a result, the triple insulated wire passes through the cut portions 51 and 6, in other word, passes through the center portion of the sheet coil-bobbin structure to be drawn out from the lower surface side of the sheet coil 11 to the upper surface side thereof. Note that when the triple insulated wire is made to pass through the sheet coil-bobbin structure, the triple insulated wire may be inserted through the cut portion 51 of the spacer 5 from the holes 7 an 8 side so as to be drawn outside from between the sheet coils 11 and 12.

Figure 2F:
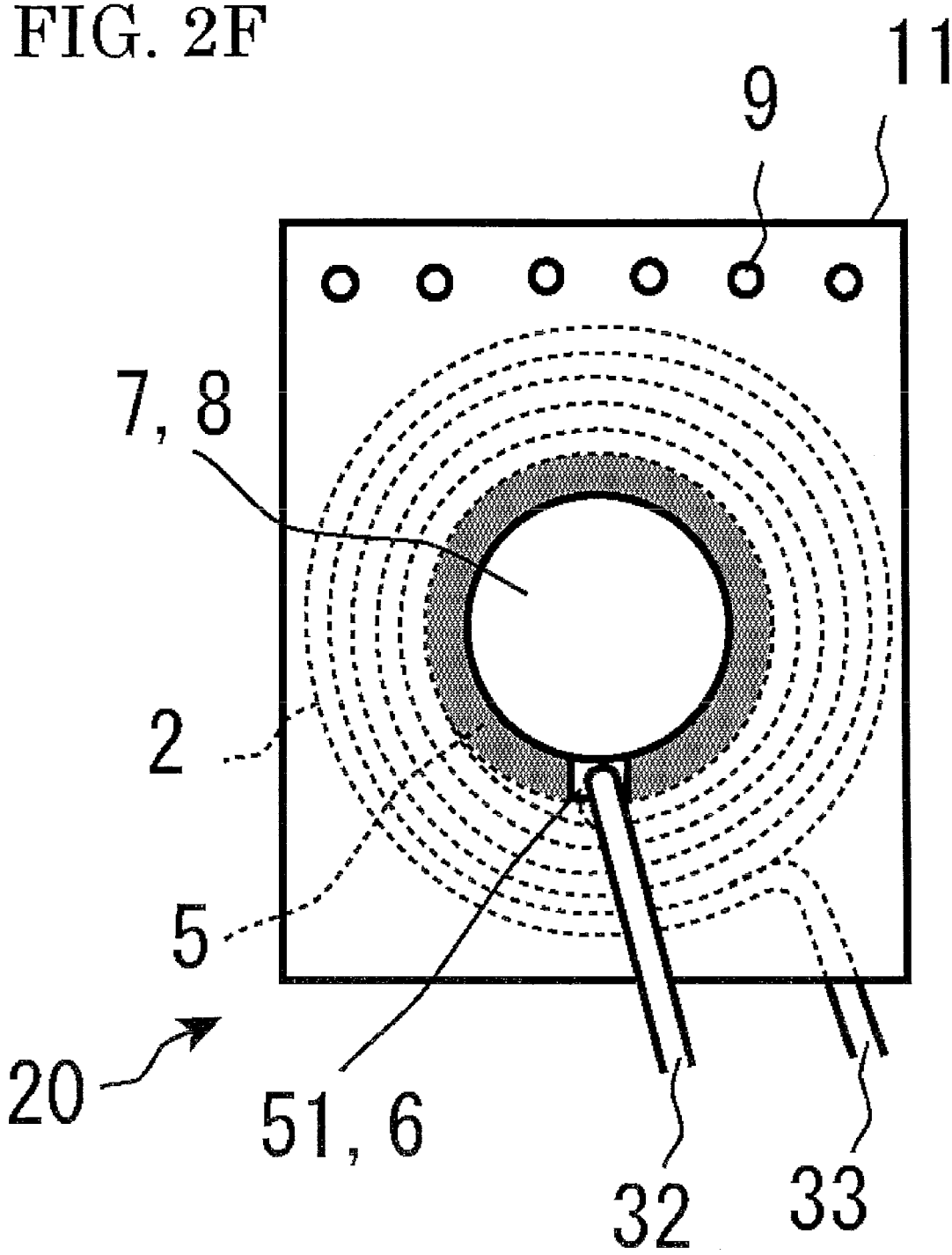

After the triple insulated wire is made to pass through the sheet coil-bobbin structure, the bobbin is made to rotate with the triple insulated wire draw-out portion 32 fixed to the upper surface of the sheet coil 11 to thereby allow the triple insulated wire to be wound between the sheet coils 11 and 12, whereby a coil 20 as illustrated in FIG. 2F is obtained. As described above, by rotating the bobbin with one end portion of the winding that has been made to pass through the sheet coil-bobbin structure, it is possible to easily wind the triple insulated wire.

Figure 2G:
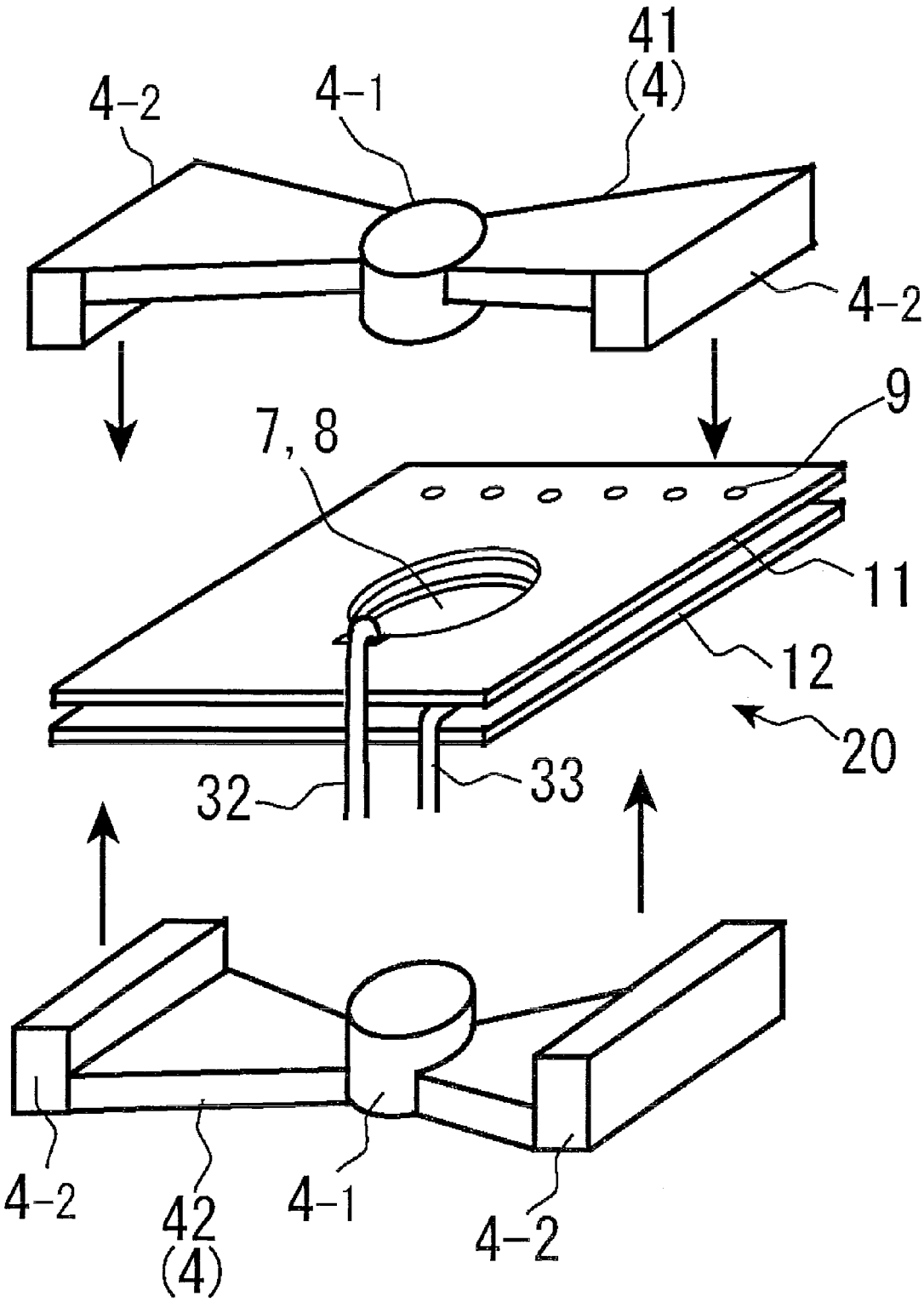
Figure 2H:
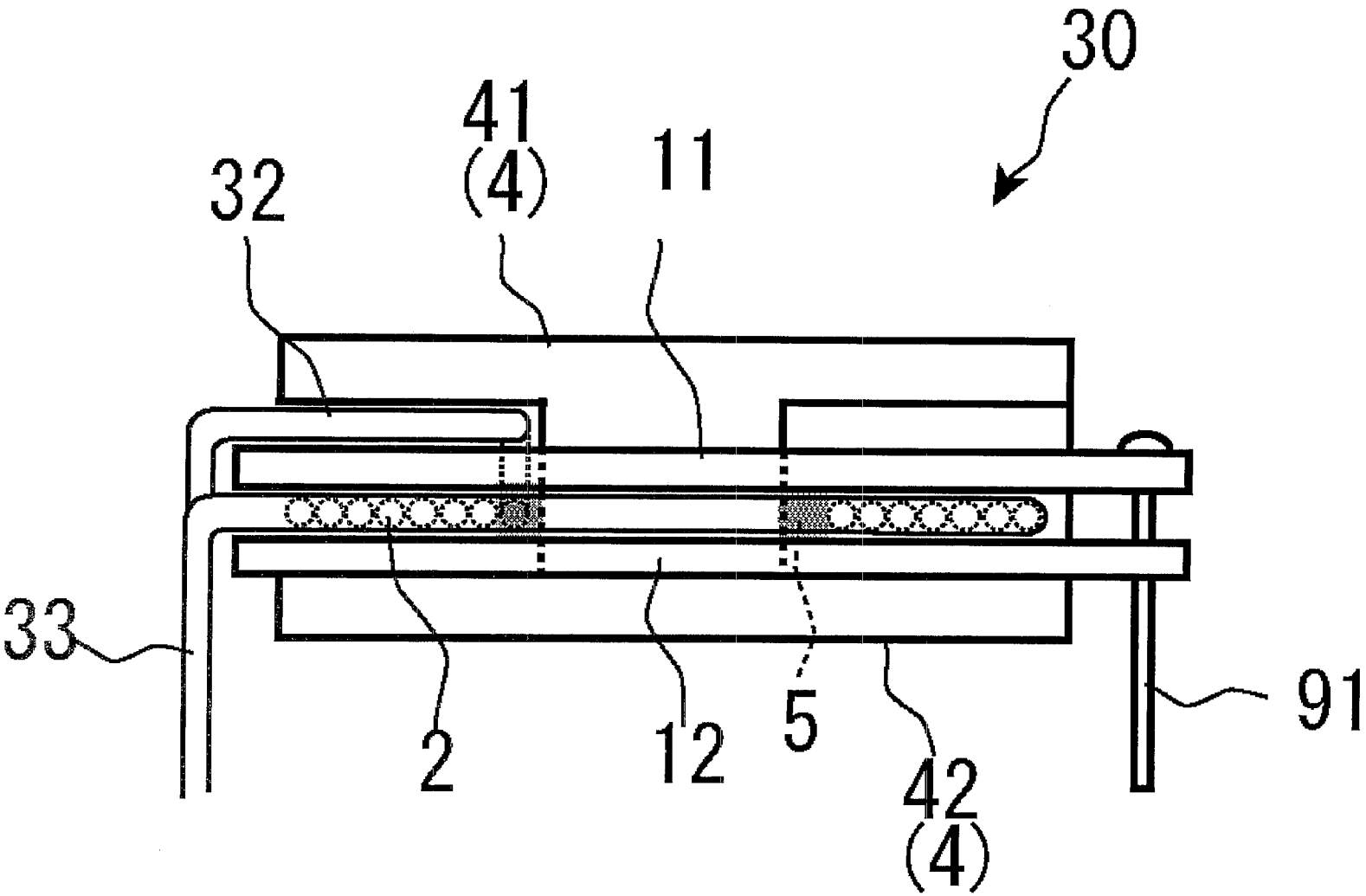

Then, as illustrated in FIG. 2G, the coil 20 and magnetic core 4 are fitted in a state where the coil 20 is interposed between an upper magnetic core 41 and a lower magnetic core 42, whereby the transformer 30 illustrated in FIG. 2H is obtained. The transformer 30 is mounted on a not-illustrated circuit board at the time of use. At this time, the transformer 30 is fixed to the not-illustrated circuit board by soldering using the fixing pins 91 and triple insulated wire draw-out portions 32 and 33. A copper wire, etc., having a predetermined mechanical strength can be used as the fixing pin 91 and is fixed by soldering to the through holes 9 and 10 of the sheet coils 11 and 12.

Figure 3:
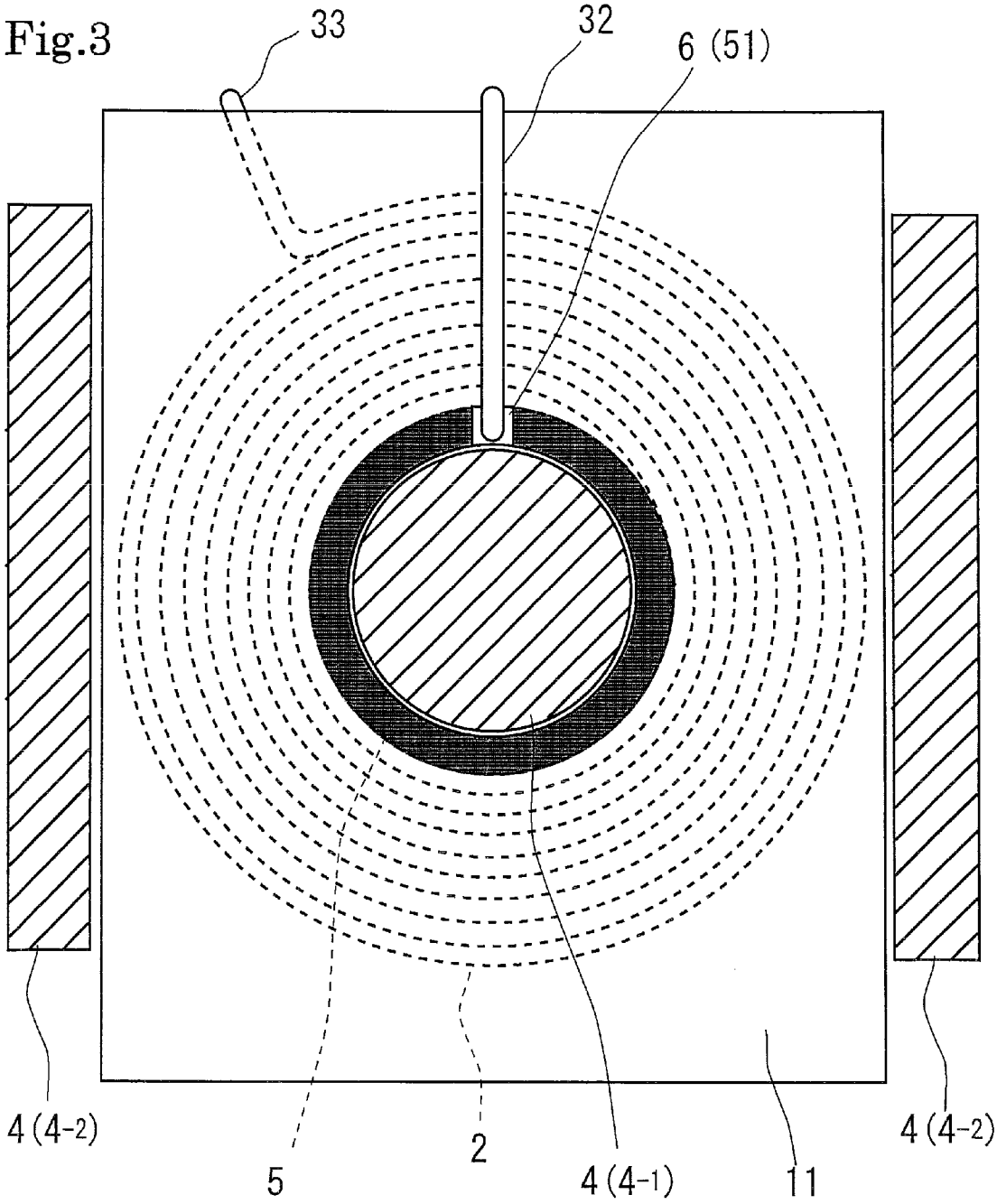
FIG. 3 is a top view of the transformer winding structure according to the first embodiment of the present invention.

FIG. 3 is a top view of the winding structure according to the present embodiment. As illustrated in FIG. 3, the winding 2 is spirally wound around the magnetic core 4 (magnetic core portion 4-1 positioned inside the winding). The triple insulated wire draw-out portion 32 is drawn out from the cut portion 6 to the upper surface of the sheet coil 11 and extends downward (in the direction toward the back side of the paper of FIG. 3) from one side of the sheet coil 11. Further, triple insulated wire draw-out portion 33 is bent at the outer peripheral portion of the winding 2 between the sheet coils 11 and 12 and extends downward (in the direction toward the back side of the paper of FIG. 3) from one side of the sheet coil 12. The spacer 5 is interposed between the winding 2 and magnetic core 4 so as to achieve electrical insulation between the winding 2 and magnetic core 4, ensure a space for the winding 2 to be wound, and serve as the bobbin core. The magnetic cores 4 (magnetic core portions 4-2 positioned outside the winding) are disposed outside opposing two surfaces other than the side from which the triple insulated wire draw-out portions 32 and 33 are drawn out. Note that FIG. 3 schematically illustrates the winding structure and omits the illustration of the through holes 9 and 10 and fixing means for the triple insulated wire draw-out portions 32 and 33.

In the transformer 30 thus constructed, the sheet coils 11 and 12 are closely attached to both the upper and lower surfaces of the winding 2 to achieve a tight coupling between the sheet coils 11 and 12 and winding 2, thereby reducing leakage inductance and thickness of the transformer.

(First Modification of First Embodiment)

Figure 4:
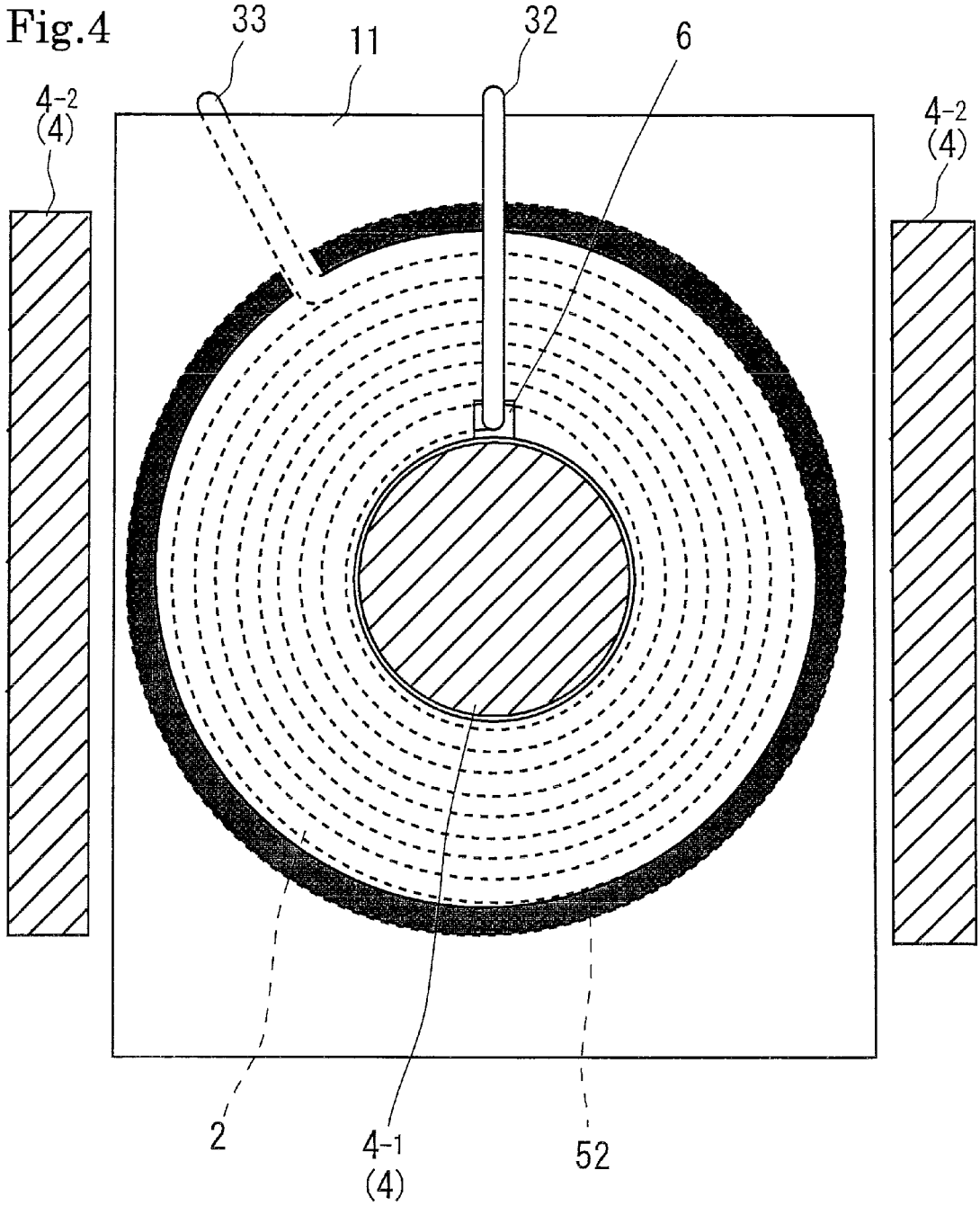
FIG. 4 is a top view of a transformer winding structure according to a first modification of the first embodiment of the present invention.

FIG. 4 illustrates a first modification of the first embodiment. In the first modification, a spacer 52 corresponding to the spacer 5 of the first embodiment is provided on the outer peripheral side of the winding 2. Other structural features are the same as those of the first embodiment. In the first embodiment, the triple insulated wire is made to pass through the sheet coil-bobbin structure followed by fixing of the triple insulated wire draw-out portion 32 and, then, the sheet coil-bobbin structure is made to rotate to thereby form the coil 20. On the other hand, in the first modification, the winding 2 formed by winding the triple insulated wire in a spiral manner is prepared and fitted to the inside of the spacer 52. After that, the resultant winding 2 and sheet coils 11 and 12 are fitted in a state where the winding 2 is interposed between the sheet coils 11 and 12, followed by bonding together. After that, the triple insulated wire draw-out portion 32 is drawn out from the cut portion 6 to the upper surface side of the sheet coil 11, and triple insulated wire draw-out portions 32 and 33 are molded in a predetermined shape, whereby assembly of the coil is completed. Alternatively, the following procedure may be employed: the spacer 52 is previously bonded to a predetermined position of the upper surface of the sheet coil 12, the prepared winding 2 is fit in the inside of the spacer 52, and the sheet coil 11 is bonded from above.

Also in the coil according to the first modification, it is possible to reduce leakage flux to reduce leakage inductance, as in the case of the coil according to the above first embodiment.

(Second Modification of First Embodiment)

Figure 5:
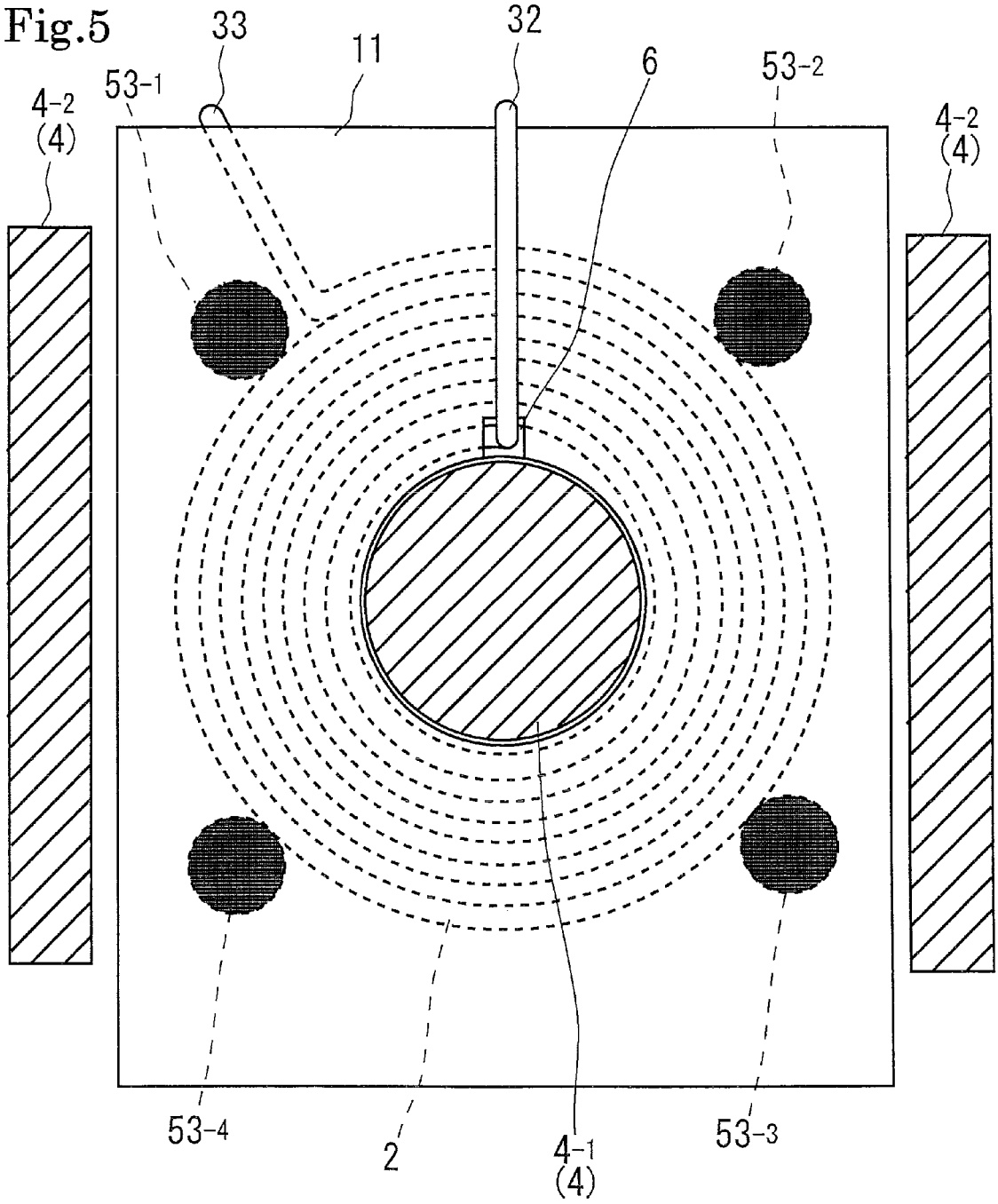
FIG. 5 is a top view of a transformer winding structure according to a second modification of the first embodiment of the present invention.

FIG. 5 illustrates a second modification in which the spacer is divided into a plurality of circular columns. As in the case of the first modification, a spacer 52 corresponding to the spacer 5 of the first modification is provided on the outer peripheral side of the winding 2. While the spacer 52 of the first modification has a ring shape, the spacer 52 of the second modification is constituted by a plurality of columnar-shaped spacers 53-1 to 53-4.

Figure 6:
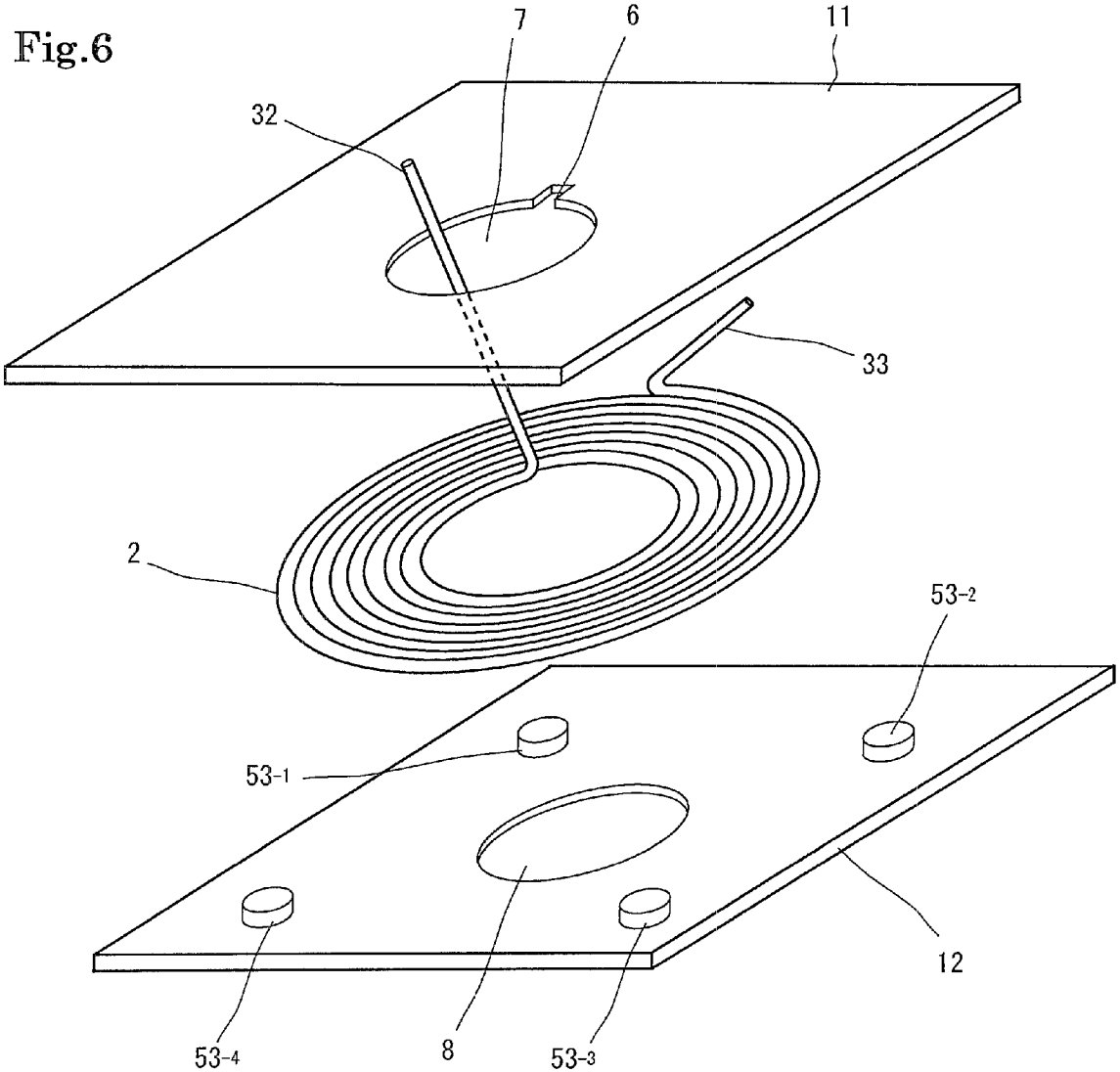
FIG. 6 is a view for explaining an assembly process of the winding of the transformer according to a second modification of the first embodiment of the present invention.

FIG. 6 illustrates an assembly state of the coil according to the second modification. As illustrated in FIG. 6, the spacers 53-1 to 53-4 are previously bonded to predetermined positions on the upper surface of the sheet coil 12. Further, the winding 2 formed by winding the triple insulated wire in a spiral manner is prepared. Then, the prepared winding 2 is fitted to a winding placement area which has been defined on the upper surface of the sheet coil 12 by the spacers 53-1 to 53-4 followed by bonding together. After that, the triple insulated wire draw-out portion 32 is drawn out from the cut portion 6 to the upper surface side of the sheet coil 11, and triple insulated wire draw-out portions 32 and 33 are molded in a predetermined shape, whereby assembly of the coil is completed. The number of the spacers 53 is not limited to four, but may be at least three for positioning of the winding 2.

Also in the coil according to the second modification, it is possible to reduce leakage flux to reduce leakage inductance, as in the case of the coil according to the above first embodiment.

Second Embodiment

Figure 7:
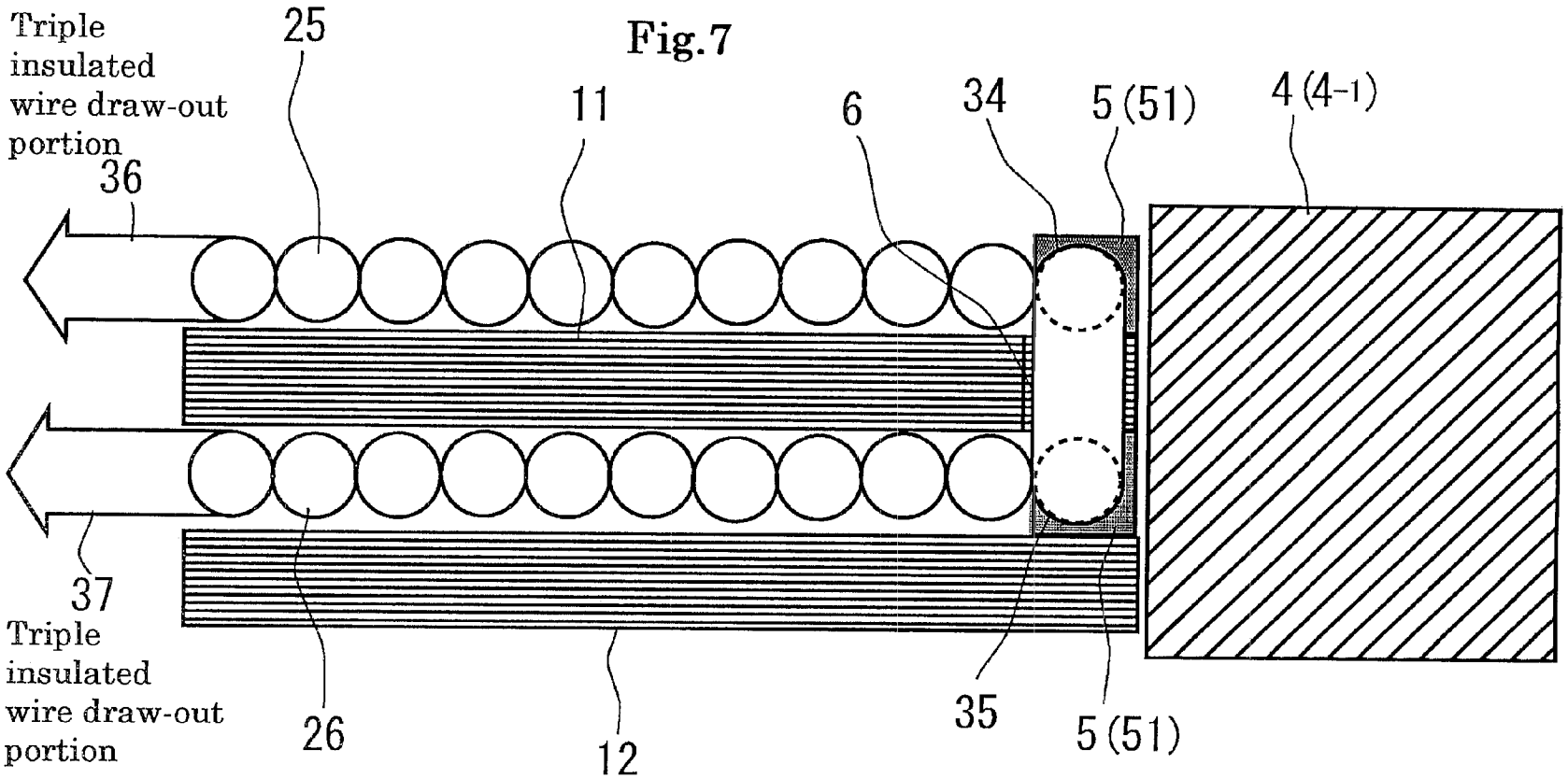
FIG. 7 is a cross-sectional view partly illustrating a transformer winding structure according to a second embodiment of the present invention.

FIG. 7 is a cross-sectional view partly illustrating a winding structure of a transformer 50 according to a second embodiment of the present invention.

In FIG. 7, reference numerals 11 and 12 each denote a sheet coil, 25 and 26 denote windings constituted by one triple insulated wire, 25 is a winding wound on the upper surface side of the sheet coli 11, 26 is a winding wound between the sheet coils 11 and 12, and 5 and 5 each denote a spacer. Reference numerals 34 and 35 denote winding start portions of the windings 25 and 26 respectively, which are connected to each other through a cut portion 6 of the sheet coil 11 and cut portions 51 of the spacers 5. Reference numerals 36 and 37 each denote a triple insulated wire draw-out portion. Reference numeral 4 denotes a magnetic core (4-1 denotes a magnetic core portion positioned inside the winding).

When forming the transformer 50 according to the present embodiment, the sheet coils 11, 12 and spacers 5, 5 are bonded to construct a sheet coil-bobbin structure and, after that, respective components are assembled together as illustrated in FIG. 8A to FIG. 8D.

More specifically, as illustrated in FIG. 2A to FIG. 2D concerning the first embodiment, the sheet coils 11, 12 and one spacer 5 are fitted together, and another spacer 5 is fitted to the upper surface of the sheet coil 11. These components are bonded together to thereby construct the sheet coil-bobbin structure. Subsequently, in a process of placing the triple insulated wire as described in FIG. 2E, the triple insulated wire is made to pass through the sheet coil-bobbin structure such that the length of the triple insulated wire extending upward from the cut portion 6 and length of the triple insulated wire extending downward from the cut portion 6 are substantially the same. This is necessary in order to ensure the lengths required to form the windings 25 and 26.

Figures 8A, 8B, 8C:
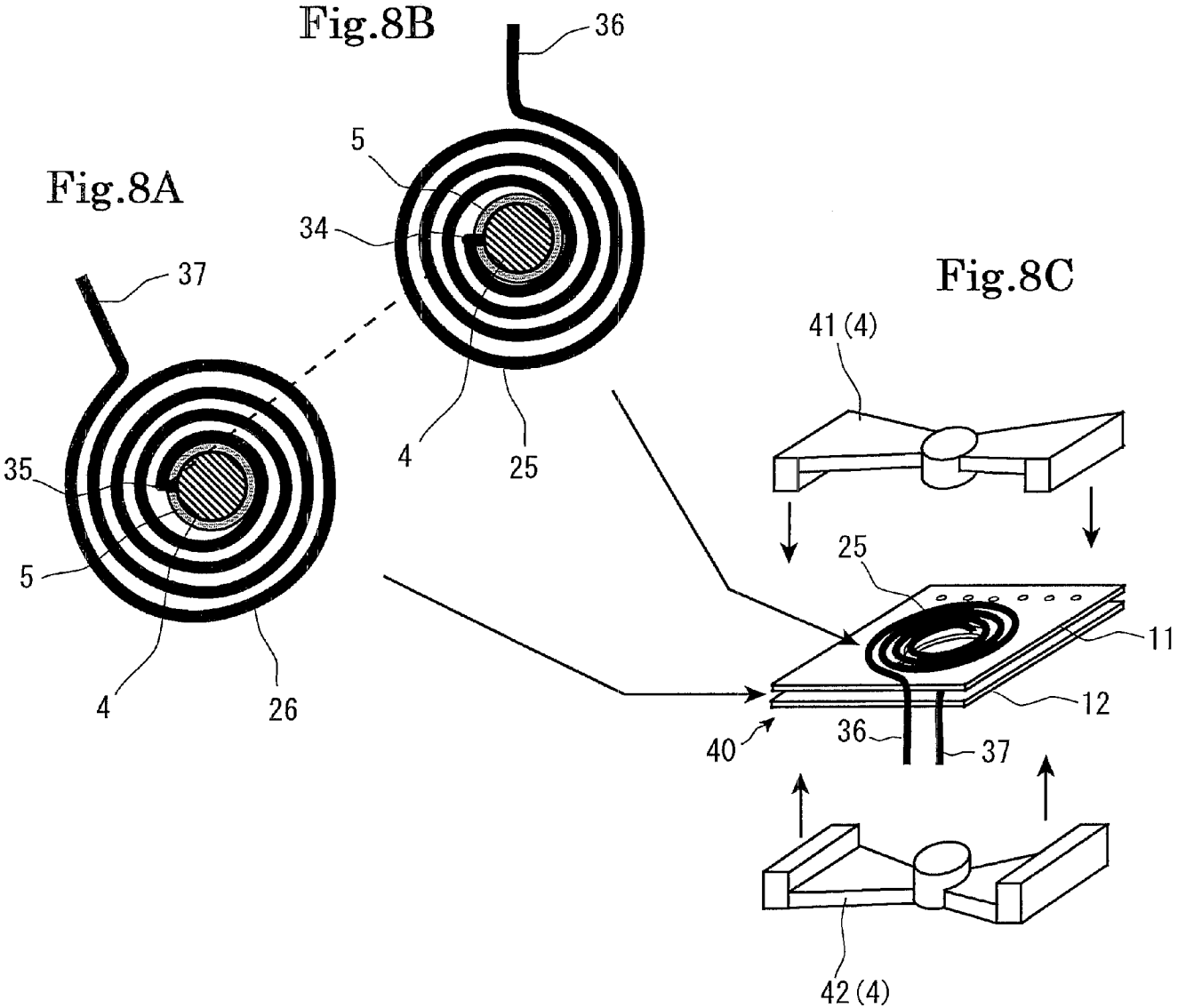
FIG. 8A to FIG. 8D are views for explaining an assembly process of the transformer according to the second embodiment of the present invention.

Then, the triple insulated wire on the upper surface side of the sheet coil 11 and triple insulated wire on the lower surface side of the sheet coil 11 (between the sheet coils 11 and 12) are wound in opposite directions to form the windings 25 and 26. That is, in the case of the winding 25, as illustrated in FIG. 8B, the triple insulated wire that has been drawn to the upper surface side of the sheet coil 11 is wound around the spacer 5 starting from the winding start portion 34 in a left-handed spiral, and the triple insulated wire draw-out portion 36 at the winding end portion is drawn out. On the other hand, in the case of the winding 26, as illustrated in FIG. 8A, the triple insulated wire on the lower surface side of the sheet coil 11 is wound around the spacer 5 starting from the winding start portion 35 in a right-handed spiral, and the triple insulated wire draw-out portion 37 at the winding end portion is drawn out. Although the winding 25 is wound in a left-handed spiral and winding 26 is wound in a right-handed spiral in the examples of FIG. 8A and FIG. 8B, the winding direction may be reversed as long as they are wound in opposite directions.

Then, the magnetic cores 41 and 42 are fitted to the thus formed coil 40 from above and below to obtain the transformer 50.

Figure 8D:
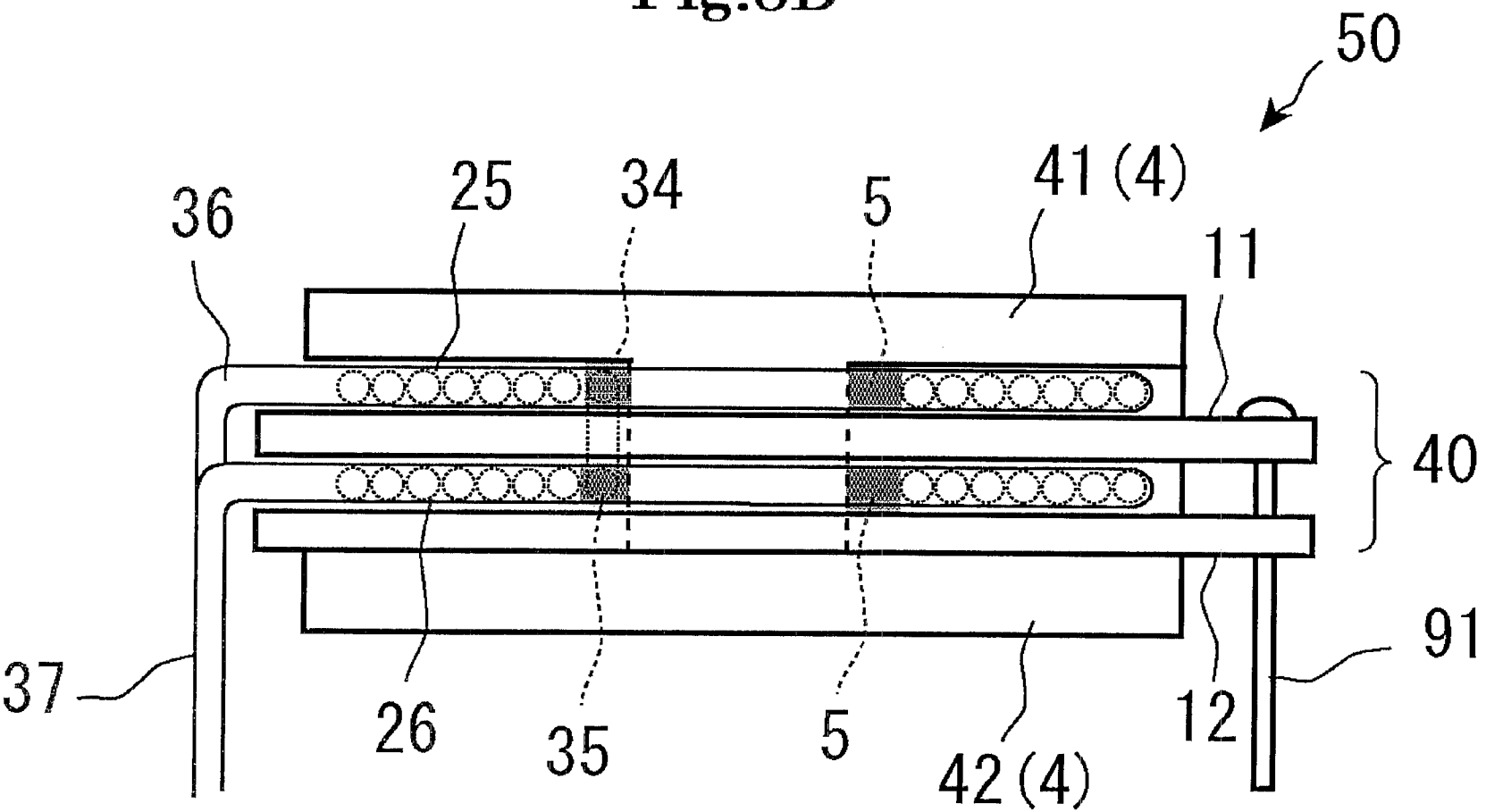

FIG. 8D illustrates the obtained transformer 50, in which the windings 25 and 26 are closely attached to both the upper and lower surfaces of the sheet coils 11.

Figure 9:
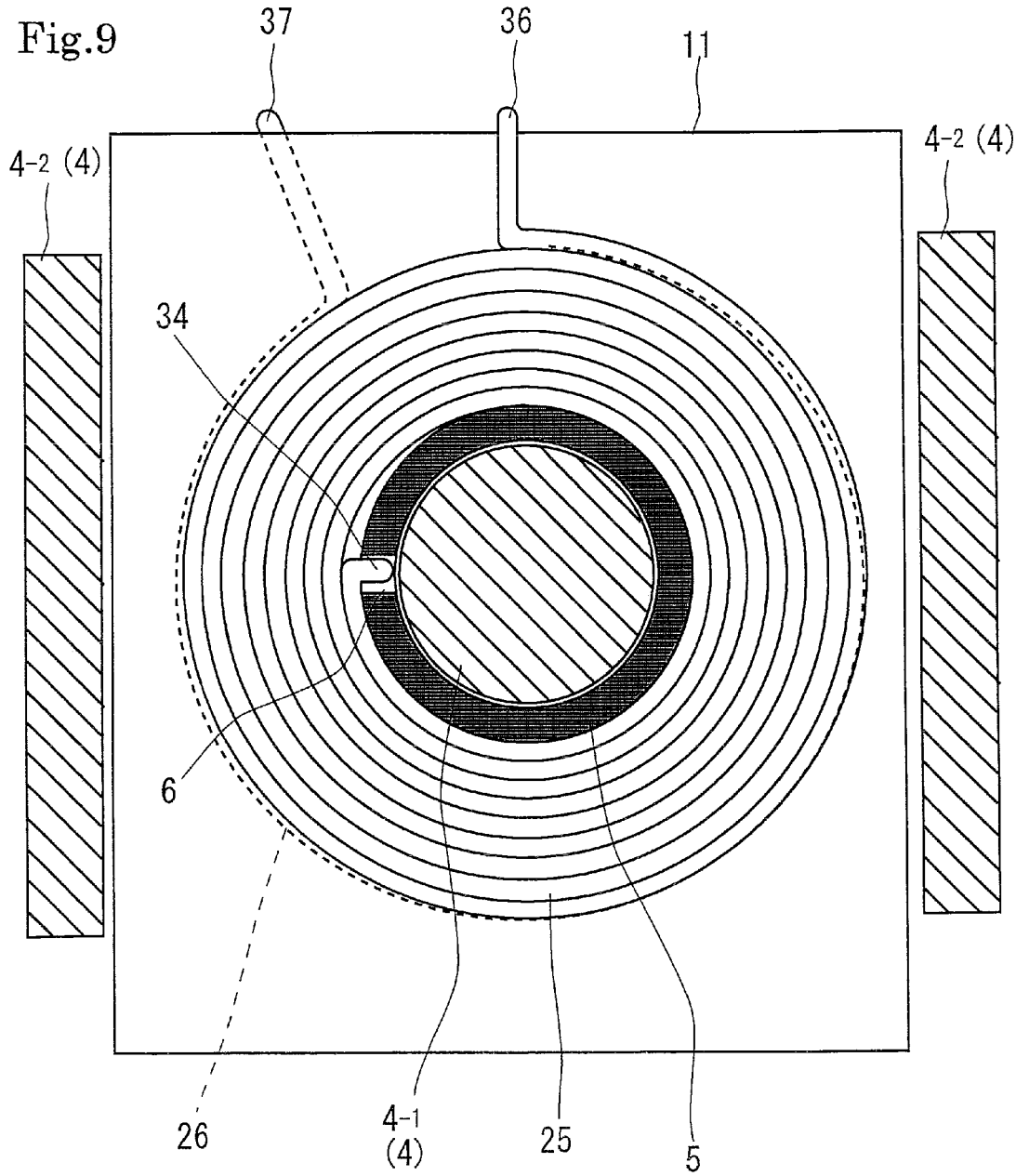
FIG. 9 is a top view of the transformer winding structure according to the second embodiment of the present invention.

FIG. 9 is a top view of the winding structure according to the present embodiment as viewed from above the winding 25. As illustrated in FIG. 9, the winding 25 is wound around the magnetic core 4 (magnetic core portion 4-1 positioned inside the winding) in a left-handed spiral on the upper surface of the sheet coil 11, and the triple insulated wire draw-out portion 36 is drawn out and extends downward (in the direction toward the back side of the paper of FIG. 9) from one side of the sheet coil 11.

On the other hand, the winding 26 is wound around the magnetic core 4 (magnetic core portion 4-1 positioned inside the winding) in a right-handed spiral on the lower surface of the sheet coil 11, and the triple insulated wire draw-out portion 37 is drawn out and extends downward (in the direction toward the back side of the paper of FIG. 9) from between one sides of the sheet coils 11 and 12.

The spacer 5 is interposed between the winding 25 and magnetic core 4 so as to achieve electrical insulation between the winding 25 and magnetic core 4 and serve as the bobbin core around which the winding 25 is wound. Further, although not illustrated in FIG. 9, the spacer 5 is also interposed between the winding 26 and magnetic core 4 so as to achieve electrical insulation between the winding 26 and magnetic core 4, ensure a space for the winding 26 to be wound, and serve as the bobbin core. The magnetic cores 4 (magnetic core portions 4-2 positioned outside the winding) are disposed outside opposing two surfaces other than the side from which the triple insulated wire draw-out portions 36 and 37 are drawn out. Note that FIG. 9 schematically illustrates the winding structure and omits the illustration of the through holes 9 and 10 and fixing means for the triple insulated wire draw-out portions 36 and 37.

According to the present embodiment, unlike the three-layer structure of the triple insulated wire including the sheet coils and winding of the first embodiment, a four-layer structure can be realized to achieve a tighter coupling between the sheet coil and winding to thereby further reduce leakage inductance. The thickness of the transformer having the four-layer structure is accordingly increased in the present embodiment. However, the windings 25 and 26 can be formed in such a manner that both the winding end portions thereof are drawn out from the outermost turns, (that is, the windings 25 and 26 can be formed as "out-out windings"), which eliminates the need to provide a space specially for the winding draw-out portions.

Third Embodiment

Figure 10:
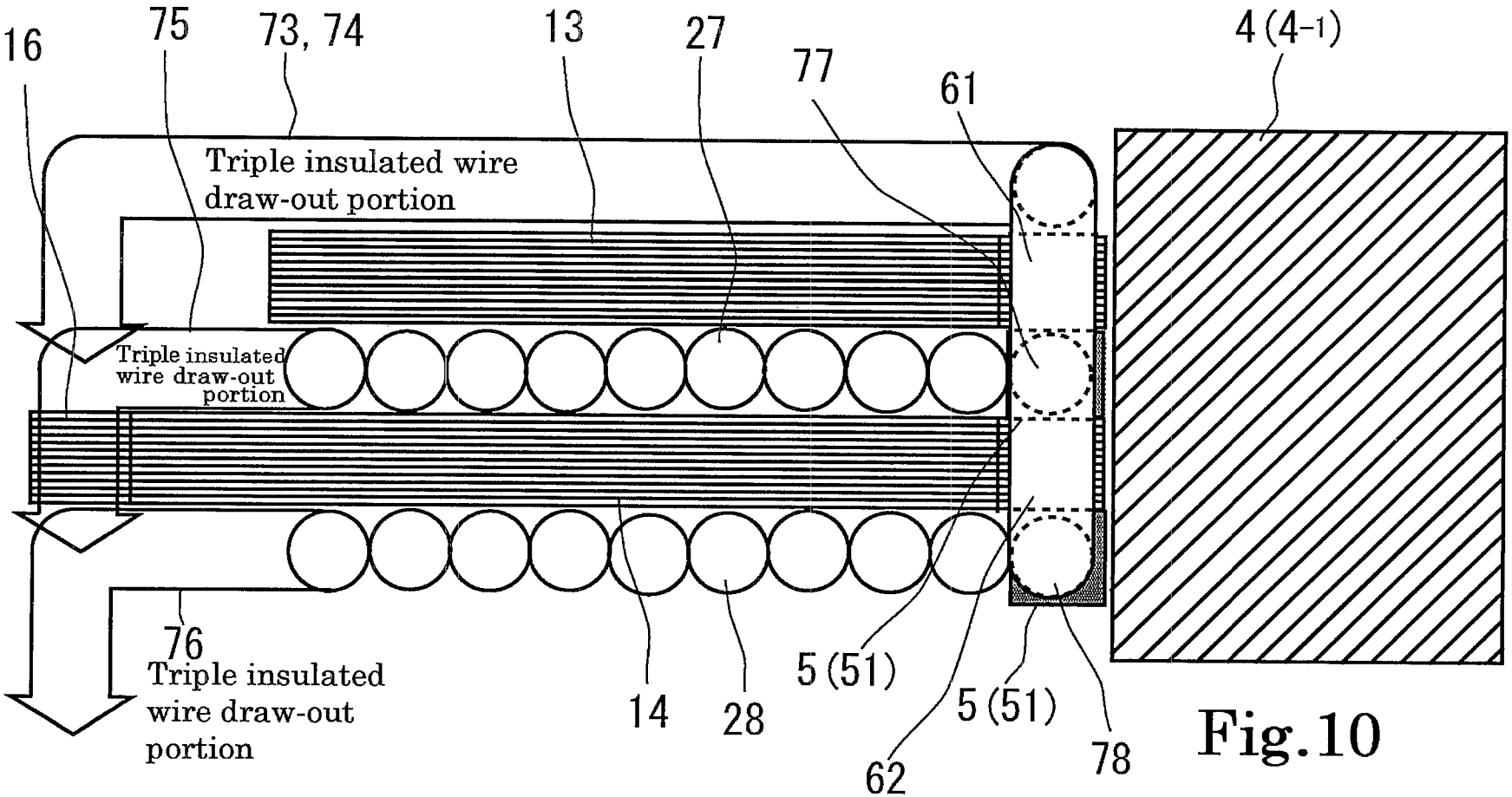
FIG. 10 is a cross-sectional view partly illustrating a transformer winding structure according to a third embodiment of the present invention.

FIG. 10 is a cross-sectional view partly illustrating a winding structure of a transformer 70 according to the third embodiment of the present invention.

In FIG. 10, reference numerals 13 and 14 each denote a sheet coil, 27 and 28 denote windings constituted by individual triple insulated wires, 27 is a winding wound between the sheet coils 13 and 14, 28 is a winding wound on the lower surface side of the sheet coil 14, 73 to 76 each denote a triple insulated wire draw-out portion, and 5 and 5 each denote a spacer. Reference numeral 4 denotes a magnetic core (4-1 denotes a magnetic core portion positioned inside the winding). A reference numeral 77 denotes a winding start portion of the winding 27, which is connected to the triple insulated wire draw-out portion 73 through a cut portion 61 of the sheet coil 13 and cut portion 51 of the spacer 5. A reference numeral 78 denotes a winding start portion of the winding 28, which is connected to the triple insulated wire draw-out portion 74 through cut portion 61 and 62 of the sheet coils 13 and 14 and cut portions 51 and 51 of the spacers 5 and 5.

Figure 11A:
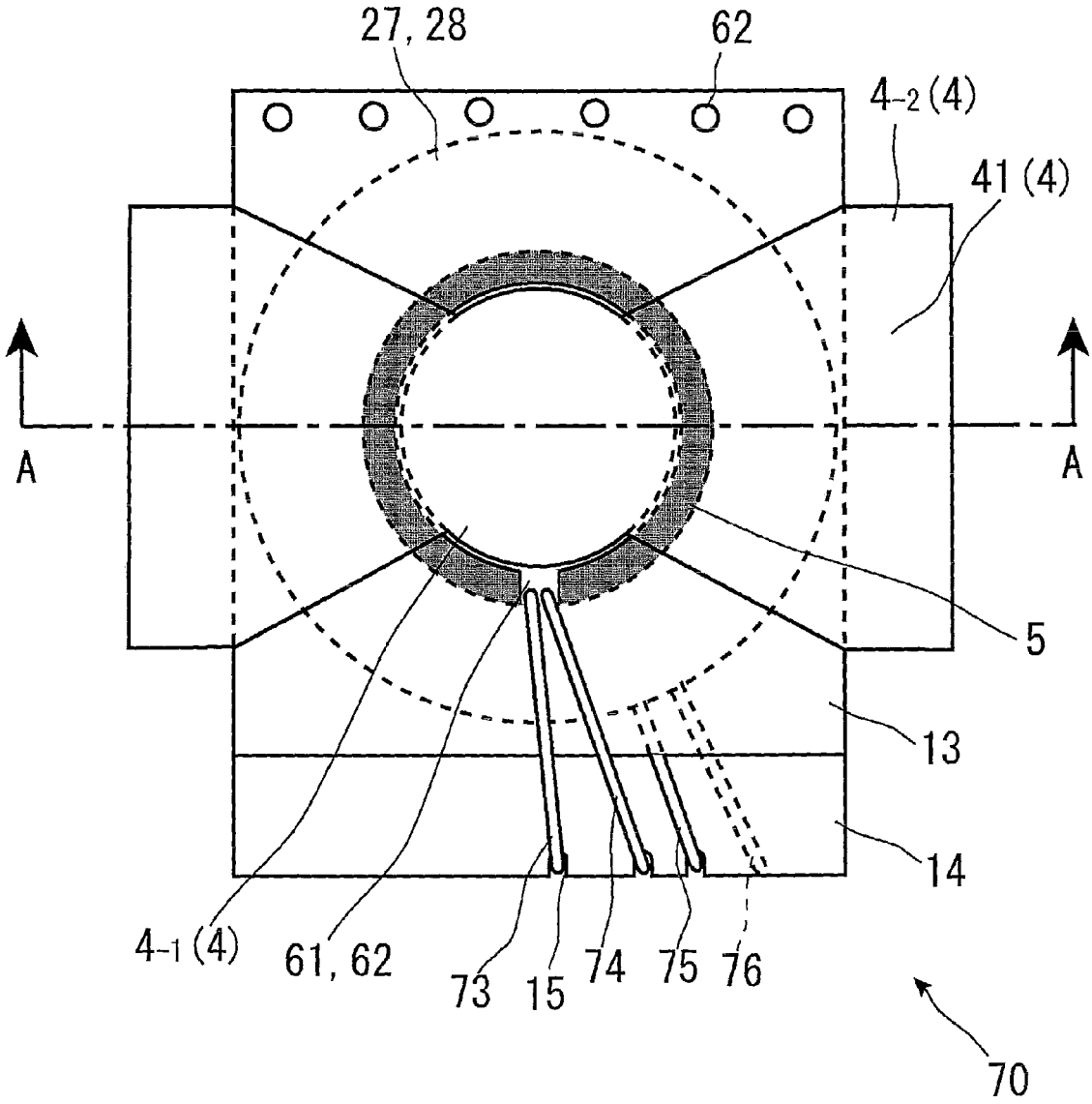
Figure 11C:
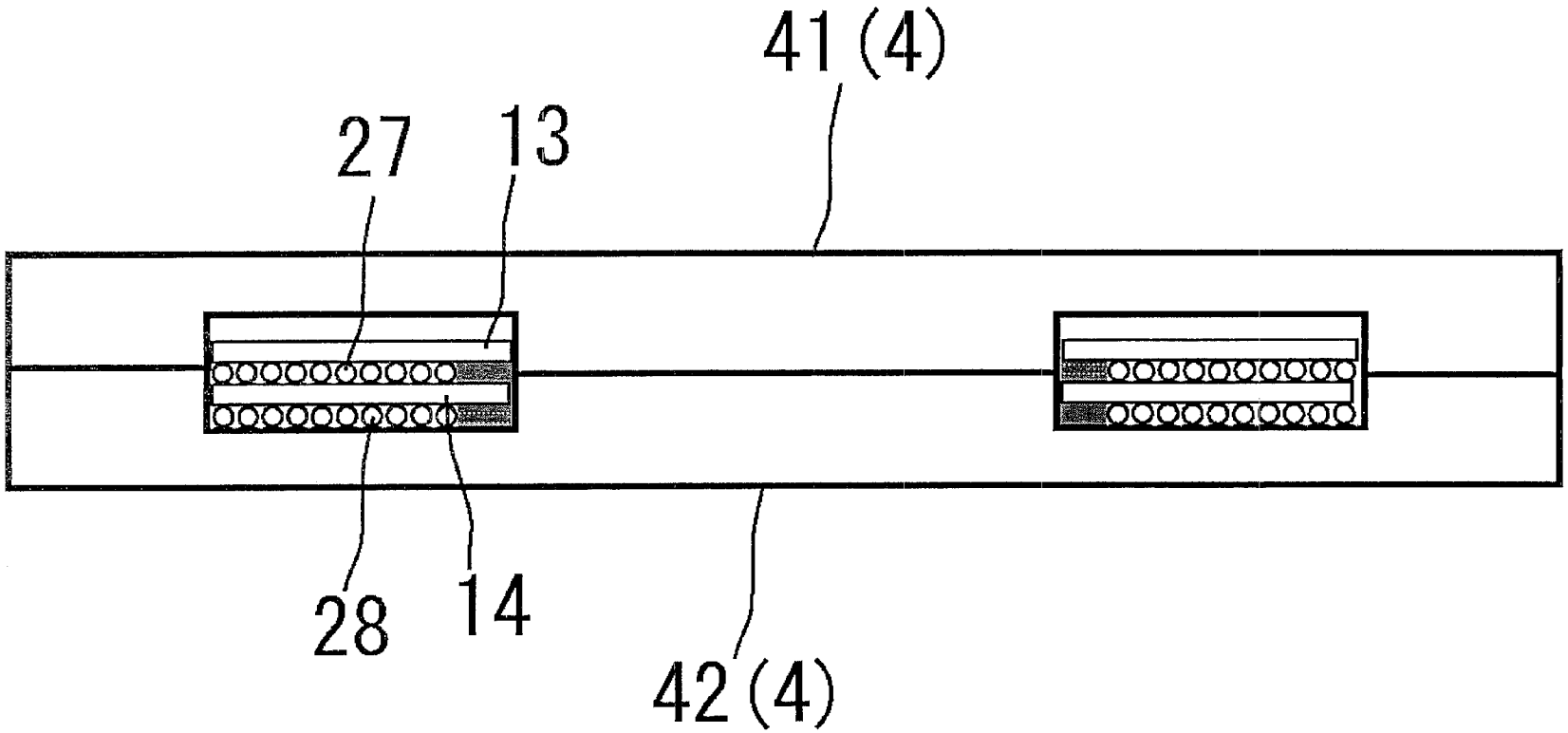
Figure 12:
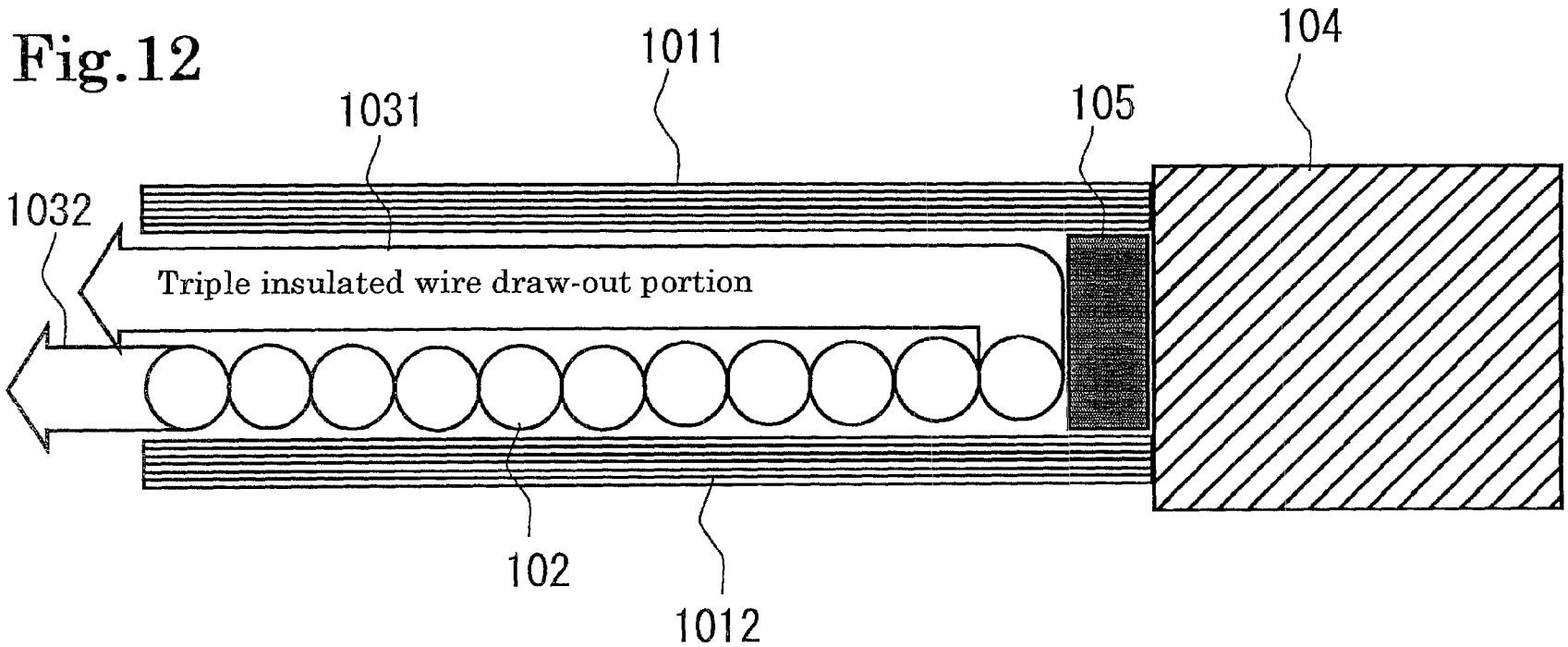
FIG. 12 is a cross-sectional view partly illustrating a configuration example of windings in a transformer according to a related art.
Figure 13:
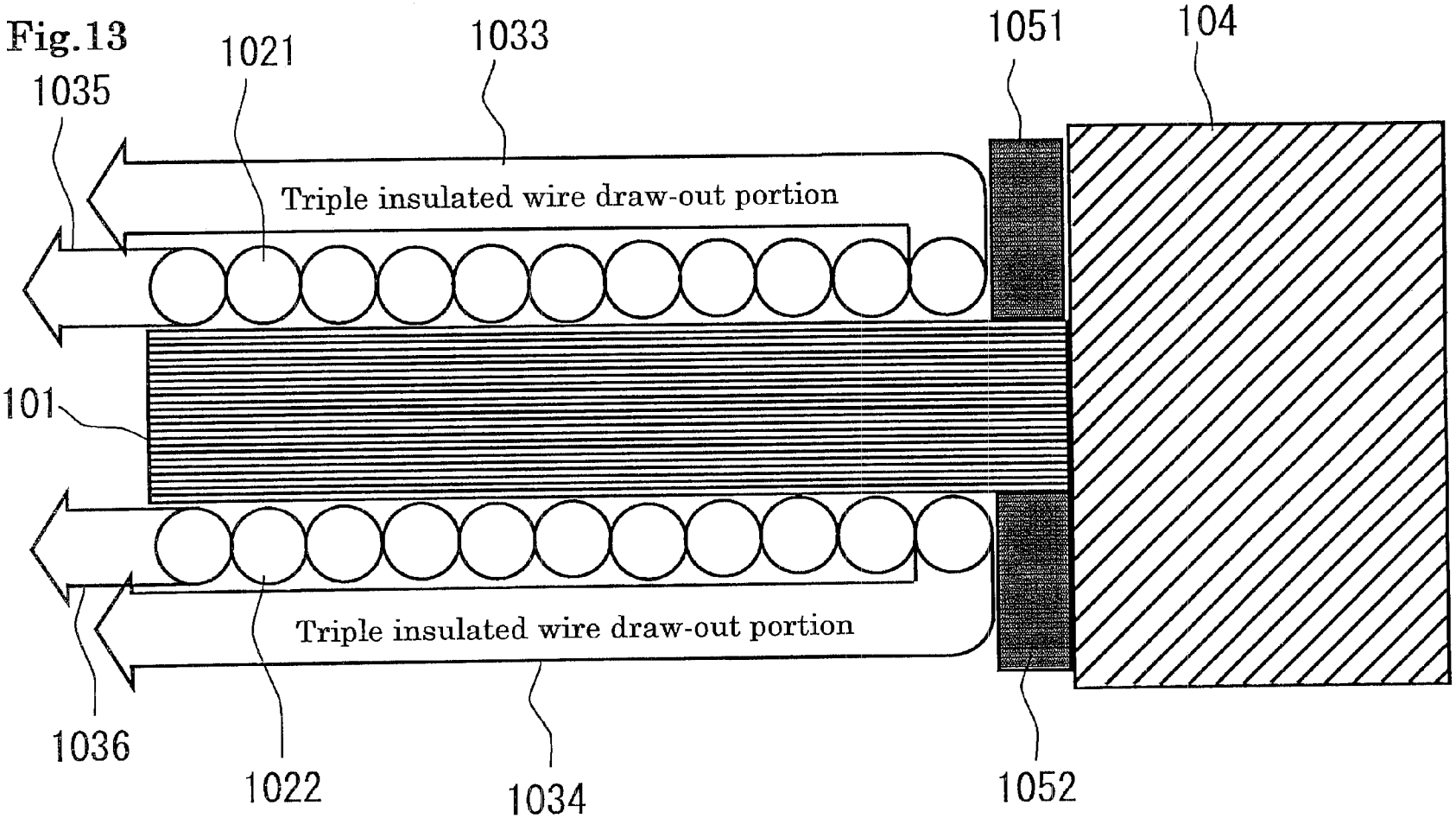
FIG. 13 is a cross-sectional view partly illustrating another configuration example of windings in a transformer according to a prior art.

FIG. 11A to FIG. 11C illustrate the structure of the transformer 70 according to the present embodiment. FIG. 11A is a plan view, FIG. 11B is a side view, and FIG. 11C is a cross-sectional view taken along A-A line of FIG. 11A.

As illustrated in FIG. 11A, the triple insulated wire draw-out portions 73 and 74 of the windings 27 and 28 are drawn out to the upper surface side of the sheet coil 13 through the cut portions 61 and 62 of the sheet coils 13 and 14. Further, the triple insulated wire draw-out portion 75 of the winding 27 is drawn out from between the sheet coils 13 and 14. Further, the triple insulated wire draw-out portion 76 of the winding 28 is drawn out from the lower surface side of the sheet coil 14. The triple insulated wire draw-out portions 73 to 75 are bent at cut portions 15, 15, 15 formed in one side of the sheet coil 14 and extend downward as illustrated in FIG. 11B. The sheet coil 13 is formed shorter in length than the sheet coil 14 so that the cut portions 15 can be easily viewed from above, making it easy for the triple insulated wire draw-out portions to be fitted in the cut portions 15. The positions of the fitted triple insulated wire draw-out portions are fixed at respective fitted portions. Further, the triple insulated wire draw-out portion 76 is bent at substantially the same position as the triple insulated wire draw-out portions 73 to 75 as viewed from the side and extends downward. A coil 60 constituted by the sheet coils 13 and 14 and windings 27 and 28 are sandwiched between magnetic cores 41 and 42, whereby a transformer 70 is obtained. The transformer 70 has through holes 62 for receiving fixing pins 91 as in the above embodiments. The transformer 70 is mounted on a not-illustrated circuit board at the time of use. At this time, the transformer 70 is fixed to the not-illustrated circuit board by soldering using the fixing pins 91 and triple insulated wire draw-out portions 73 to 76.

In the present embodiment, the sheet coils 13 and 14 having the configuration corresponding to that of the sheet coil 11 are prepared in place of the sheet coils 11 and 12 employed in the first embodiment followed by bonding together as illustrated in FIG. 2D. After that, the winding start portion 77 of the winding 27 is made to pass through between the sheet coils 13 and 14 to the upper surface side of the sheet coil 13 as the triple insulated wire draw-out portion 73, and the winding start portion 78 of the winding 28 is guided from the lower surface side of the sheet coil 14 to the upper surface side of the sheet coil 13 as the triple insulated wire draw-out portion 74. Then, by rotating a sheet coil-bobbin structure constituted by the sheet coils 13 and 14 with the triple insulated wire draw-out portions 73 and 74 fixed to the upper surface of the sheet coil 13, the triple insulated wire is wound between the sheet coils 13 and 14 and at the lower surface side of the sheet coil 14, whereby the coil 60 as illustrated in FIG. 10 is obtained. In this case, a use of a jig forming a bobbin combined with the sheet coil 14 on the lower surface side of the winding 28 allows the winding 28 to be wound easily. Thus, by rotating the bobbin with one end of the winding that has been made to pass through the sheet coil-bobbin structure fixed as in the case of the first embodiment, it is possible to easily wound the triple insulated wire.

According to the present embodiment, by rotating the bobbin with one end of the winding that has been made to pass through the sheet coil-bobbin structure fixed as in the case of the first embodiment, it is possible to easily wound the triple insulated wire.

Further, when the triple insulated wire draw-out portions 73, 74 and triple insulated wire draw-out portions 75, 76 are connected to each other by wiring of a printed board on which the transformer 70 is mounted so as to allow the windings 27 and 28 to be connected in parallel, the current capacity can be doubled. Further, serial connection between the windings 27 and 28 can be made depending on the connection configuration between the triple insulated wire draw-out portions 73 and 74 and triple insulated wire draw-out portions 75 and 76. In this case, the number of turns can be doubled.

Further, as in the case of the above second embodiment, a four-layer structure can be realized to achieve a tighter coupling between the primary winding and secondary winding to thereby further reduce leakage inductance, although the thickness of the transformer is increased.

Although the winding structure of the present embodiment is the four-layer structure, a multilayer structure of six-layer, eight-layer, . . . can be achieved by further stacking a set (or sets) of the sheet coil and winding on the lower surface side of the winding 28. In this case, the triple insulated wire draw-out portions of each added winding is, as in the case of the triple insulated wire draw-out portions 73 and 74, are draw out to the upper surface side of the sheet coil 13 through the cut portion 61 and 62 of the sheet coils 13 and 14 and a cut portion of the added sheet coil. The widths of the cut portion 61 and 62 of the sheet coils 13 and 14 and cut portion of the added sheet coil may be increased so that the respective draw-out wires can be made to pass therethrough. Further, the triple insulated wire draw-out portions of the respective windings formed over a plurality of layers can be connected to each other in series, in parallel, or independently (a plurality of windings may be independent windings each connected in series or in parallel) by wiring on a printed board on which the transformer 70 is mounted. In the case where the windings are connected in series, a transformer capable of handling middle to high output voltage of about 100 V or 200 V can be obtained. In the case where the windings are connected in parallel, a transformer capable of handling low voltage and large current can be obtained. In the case where the windings are independently connected, a transformer capable of handling multi-output can be obtained.

Although the transformer is taken as an example of the inductance part in the above embodiment, the present invention is not limited to this, but may be applied to other inductance parts such as a choke coil provided with a plurality of windings. Further, although the triple insulated wire is used to form the winding, not only the triple insulated wire, a wire having at least one insulated layer may be used as long as the specification of insulation is satisfied. Further, although a shell-type transformer is used in the above embodiments, a core-type transformer may be employed.

Although the present invention has been described in detail with reference to the above embodiment, it should be understood that the above embodiments are merely examples, and the present invention is not limited thereto.

The present invention may be applied to an inductance part such as a transformer or choke coil provided with a plurality of windings.

What is claimed is:

1. An inductance part provided with a magnetic core, a sheet coil, and an insulated wire, comprising:

a bobbin constituted by two or more sheet coils; and a winding formed by winding the insulated wire between the two or more sheet coils constituting the bobbin, wherein a draw-out wire on the center side of the winding passes through the center portion of the bobbin to be drawn out to one outer surface side of the bobbin.

2. The inductance part according to claim 1, wherein a hole through which the magnetic core is inserted is formed in the sheet coil, and a cut portion through which the draw-out wire of the winding passes is formed in the outer peripheral portion of the hole.

3. The inductance part according to claim 1, wherein the draw-out wire on the center side of the winding that has been drawn out from the center portion of the bobbin is wound in the opposite direction to the winding on the one outer surface of the bobbin to form a winding.

4. The inductance part according to claim 1, wherein the bobbin includes, between the two or more sheet coils, a spacer for forming a space within which the winding is accommodated.

5. The inductance part according to claim 4, wherein the spacer is disposed between the winding and magnetic core.

6. The inductance part according to claim 5, wherein a cut portion through which the draw-out wire of the winding passes is formed in the spacer.

7. The inductance part according to claim 4, wherein the spacer is disposed so as to be brought into contact with the outer periphery of the winding.

8. The inductance part according to claim 1, wherein another winding is disposed on another outer surface side opposite to the one outer surface side of the bobbin to which the draw-out wire is drawn out, and a draw-out wire of the another winding on the center side thereof is drawn out, through the two or more sheet coils, to the one outer surface side of the bobbin to which the draw-out wire of the winding has been drawn out.

9. The inductance part according to claim 8, comprising:

three or more sheet coils; and two or more windings sandwiched between the three or more sheet coils, wherein draw-out wires of the two or more windings interposed between the three or more sheet coils are drawn out, through the three or more sheet coils sandwiching the two or more windings, to the one outer surface side of the bobbin.

10. The inductance part according to claim 6, wherein the draw-out wire of the winding is wound in the opposite direction to the winding on the one outer surface of the bobbin to form a winding.

11. The inductance part according to claim 2, wherein the bobbin includes, between the two or more sheet coils, a spacer for forming a space within which the winding is accommodated, and a cut portion through which the draw-out wire of the winding passes is formed in the spacer.

* * * * *